US011992114B2

(12) United States Patent
Hoskins et al.

(10) Patent No.: US 11,992,114 B2
(45) **Date of Patent: *May 28, 2024**

(54) FLEXIBLE FLUID RESERVOIRS WITH CLOSURES AND STRUCTURAL MEMBERS

(71) Applicant: TSI Manufacturing, LLC, Bend, OR (US)

(72) Inventors: Matthew Hoskins, Bend, OR (US); Robert Smith, Bend, OR (US)

(73) Assignee: TSI Manufacturing LLC, Bend, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/240,290

(22) Filed: Aug. 30, 2023

(65) Prior Publication Data

US 2023/0404246 A1 Dec. 21, 2023

Related U.S. Application Data

(60) Continuation of application No. 18/082,824, filed on Dec. 16, 2022, which is a division of application No. 17/378,558, filed on Jul. 16, 2021, now Pat. No. 11,540,615.

(60) Provisional application No. 63/178,620, filed on Apr. 23, 2021, provisional application No. 63/103,111, filed on Jul. 20, 2020.

(51) Int. Cl.

| | |
|---|---|
| ***A45F 3/20*** | (2006.01) |
| ***B65D 33/02*** | (2006.01) |
| ***B65D 33/06*** | (2006.01) |
| ***B65D 33/16*** | (2006.01) |
| ***B65D 55/16*** | (2006.01) |

(52) U.S. Cl.
CPC ..... *A45F 3/20* (2013.01); *B65D 33/02* (2013.01); *B65D 33/06* (2013.01); *B65D 33/16* (2013.01); *B65D 55/16* (2013.01)

(58) Field of Classification Search
CPC ..... A45F 3/20; B65D 33/02; B65D 33/06; B65D 33/16; B65D 55/16
USPC ..... 383/12
See application file for complete search history.

(56) References Cited

U.S. PATENT DOCUMENTS

| | | | |
|---|---|---|---|
| 2,622,647 | A | 12/1952 | Arnthal |
| 4,753,489 | A | 6/1988 | Mochizuki |
| 5,941,640 | A | 8/1999 | Thatcher |
| 9,994,362 | B2 | 6/2018 | Hoskins |
| 10,624,438 | B2 | 4/2020 | Hoskins |
| 11,161,655 | B2 | 11/2021 | Hoskins et al. |

(Continued)

*Primary Examiner* — Jes F Pascua
(74) *Attorney, Agent, or Firm* — Klarquist Sparkman, LLP

(57) ABSTRACT

Disclosed fluid reservoirs include a 3-D formed first sheet and a 3-D formed second sheet. The 3-D formed first sheet and the 3-D formed second sheet are sealed together at least partially around respective perimeter edges thereof to define an internal space for fluid storage. There is a first opening defined between the 3-D formed first sheet and the 3-D formed second sheet at a first end of the fluid reservoir. The first opening is configured for filling the fluid reservoir with fluid. There is a second opening defined between the 3-D formed first sheet and the 3-D formed second sheet at a second end of the fluid reservoir opposite the first end. The second opening has a fluid exit port configured for allowing fluid to exit the fluid reservoir. The reservoir can include an optional baffle that is coupled to the 3-D formed first and second sheets.

8 Claims, 43 Drawing Sheets

(56) References Cited

U.S. PATENT DOCUMENTS

| | | | | |
|---|---|---|---|---|
| 11,540,615 | B2 * | 1/2023 | Hoskins | B65D 33/06 |
| 2008/0169321 | A1 * | 7/2008 | Fidrych | A45F 3/20 224/148.2 |
| 2008/0277433 | A1 * | 11/2008 | Karl | A45F 3/20 224/148.6 |
| 2011/0091136 | A1 | 4/2011 | Danch | |
| 2015/0093052 | A1 | 4/2015 | Hoskins | |
| 2016/0236826 | A1 | 8/2016 | Hoskins | |
| 2017/0240319 | A1 * | 8/2017 | Lyon | A45F 3/16 |
| 2017/0127806 | A1 | 11/2017 | Smith et al. | |
| 2017/0347778 | A1 | 12/2017 | Hoskins | |
| 2019/0320781 | A1 | 10/2019 | Hoskins | |
| 2020/0290781 | A1 | 9/2020 | Hoskins et al. | |
| 2021/0401155 | A1 * | 12/2021 | Bouhnik | A45F 3/20 |

* cited by examiner

FIG. 39
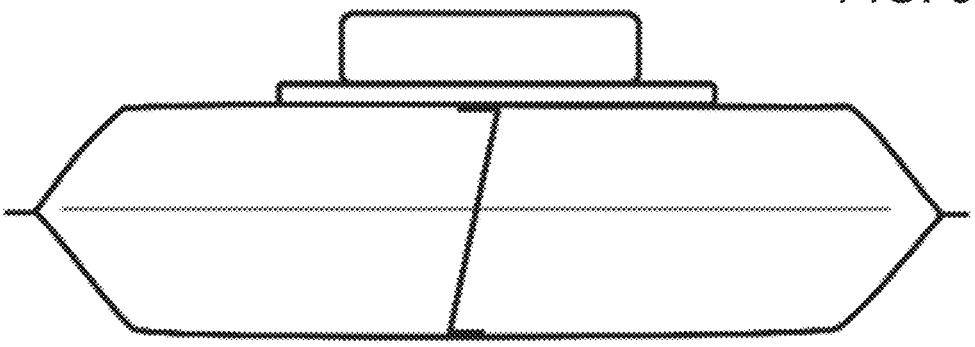
FIG. 40A
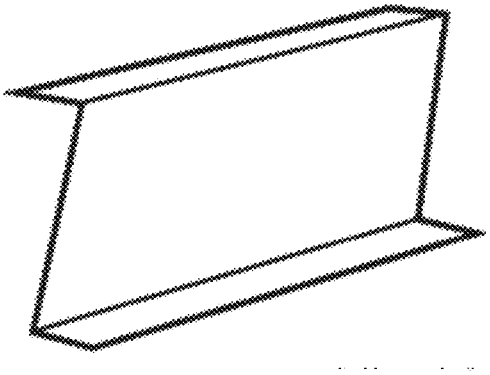
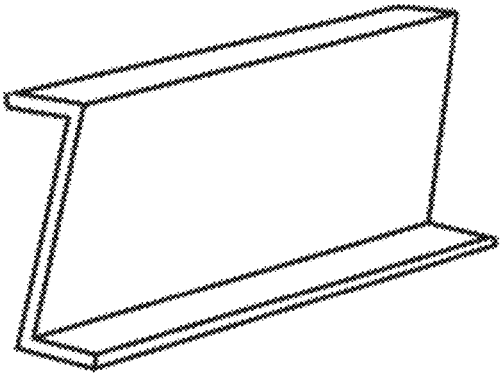
FIG. 40B
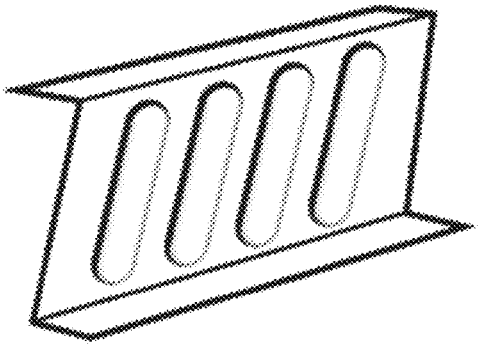
FIG. 40C

FLEXIBLE FLUID RESERVOIRS WITH CLOSURES AND STRUCTURAL MEMBERS

CROSS-REFERENCE TO RELATED APPLICATIONS

This application is a continuation of U.S. patent application Ser. No. 18/082,824, filed Dec. 16, 2022, which is a divisional of U.S. patent application Ser. No. 17/378,558, filed Jul. 16, 2021, now U.S. Pat. No. 11,540,615, which claims the benefit of U.S. Provisional Patent Application No. 63/103,111, filed Jul. 20, 2020, and U.S. Provisional Patent Application No. 63/178,620, filed Apr. 23, 2021, which applications are incorporated by reference herein in their entirety.

Additional information about the technology disclosed here is described in U.S. patent application Ser. No. 16/749,830, filed Jan. 22, 2020; U.S. patent application Ser. No. 16/687,040, filed Nov. 18, 2019; U.S. patent application Ser. No. 16/393,835, filed Apr. 24, 2019; U.S. patent application Ser. No. 15/344,334, filed Nov. 4, 2016; U.S. Pat. No. 9,994,362, issued Jun. 12, 2018; and U.S. Pat. No. 10,624,438, issued Apr. 21, 2020; all of which are incorporated by reference herein in their entirety.

FIELD

This application relates to fluid bladders and other flexible fluid storage containers.

BACKGROUND

Wearable personal hydration systems are used by athletes, recreationalists, workers, military personnel, and others, to provide convenient access to fluid while in action. For activities requiring more than a liter of fluid, for example, a soft-sided fluid reservoir carried in a backpack or waistpack is often used. Hydration systems such as this can consist of a pack and a soft-sided reservoir paired with a flexible drink tube ending in a closable mouthpiece. Fluid capacities for pack-mounted reservoirs typically range from 1 to 3 liters. They often feature a sealable fill port and an exit port at the base of the reservoir which connects to the drink tube. Fill and exit ports can be integrated into the edge of the soft-sided reservoir or sealably attached to the reservoir's flat top surface. The drink tube ends in a mouthpiece which can be activated by the user to initiate fluid flow.

Pack-mounted hydration reservoir systems provide storage and access for longer-term physical activity. With their soft sides they can be relatively comfortable against the body and they have the added benefit of collapsing near flat when they are empty. Their collapsibility also helps minimize fluid sloshing. The mouthpiece can be tethered to the chest area for easy access and drinking can be largely hands-free.

While the collapsibility of soft sided reservoirs provides convenience and they are lightweight, their shape when full and their difficulty of filling and cleaning can be problematic. A typical flat reservoir will take a roughly cylindrical shape when filled with fluid, making it uncomfortable to carry next to the user's body. When empty of fluid, the reservoir returns to its totally flat shape, trapping residual liquid between the front and back sheets, limiting the ability of the reservoir to inhibit bacteria growth by drying out. A reservoir's collapsed nature can also make it hard to fill. For some type of reservoir ports, the user may need to manually hold the reservoir open in order to start the filling process.

Accordingly, it would be advantageous to construct a hydration reservoir that features the benefits of reliable sealing, collapsibility, comfort, and lightness while facilitating filling, drying, and reservoir shaping.

SUMMARY

Disclosed herein are flexible fluid reservoirs that can include closure mechanisms for sealing an upper opening of the reservoir. The reservoir can be formed from two flexible sheets sealed around a perimeter, leaving an upper portion open to define the upper opening. Two or more semi-rigid plates can be coupled to one or both sheets adjacent the upper opening. When the upper end of the reservoir is flattened and folded, the plates can be positioned on opposite sides of the folded sheets, and a closure frame can be slid over the plates to pressure them together. The plates can have pins that project outwardly and that engage with slots in the closure frame, and a separate closure lock can be slid over a lateral end of the closure frame to prevent at least some of the pins from exiting the slots. The plates can also have a natural curvature that acts to bias the upper open when the closure is not engaged.

Also disclosed are flexible fluid reservoirs that include structural elements, such as internal baffles or external plates, that help retain a desired shape of the reservoir when filled and/or empty. Some baffles can be elastically deformable to allow flattening and expansion of the bladder while biasing the bladder toward a neutral position.

The foregoing aspects and many of the attendant advantages of the disclosed technology will become more readily appreciated by reference to the following detailed description and accompanying drawings.

BRIEF DESCRIPTION OF THE DRAWINGS

FIGS. 21A and 213 show the top and front and back views of an exemplary bladder with its top opening in an open position.

FIGS. 29A and 2913 show front and side views of an exemplary reservoir with a foldable rigid element in an expanded state.

FIGS. 31A and 3113 show front and side views of a reservoir with a shaped baffle in an expanded state.

FIG. 39 shows a cross-sectional view of a reservoir having a Z-shaped spring baffle.

FIGS. 40A-40C are perspective views of various exemplary Z-shaped spring baffles.

DETAILED DESCRIPTION

Disclosed herein are closure mechanisms for sealing an upper opening of a bladder or other flexible fluid reservoir. The disclosed closure mechanisms can provide easy and reliable sealing. Also disclosed herein are flexible fluid reservoirs that include structural elements that help retain a desire shape of the reservoir when filled or empty.

Any of the embodiments or features disclosed in this application may be combined with any other embodiments or features disclosed elsewhere in this application without limitation, and all such combinations are expressly included as part of this application. For example the features described herein in relation to flexible fluid reservoirs with structural elements for retaining a desired reservoir shape can be combined with the features described herein in relation to closure mechanisms for top-fill openings.

As used herein, the singular terms "a", "an", and "the" include plural referents unless context clearly indicates otherwise. The term "comprises" means "includes without limitation." The term "coupled" means physically linked and does not exclude intermediate elements between the coupled elements. The term "and/or" means any one or more of the elements listed. Thus, the term "A and/or B" means "A", "B" or "A and B."

Although methods and materials similar or equivalent to those described herein can be used in the practice or testing of the present technology, only certain suitable methods and materials are described herein. The devices, materials, methods, and other features described herein are illustrative only and not intended to be limiting.

Figure 1:
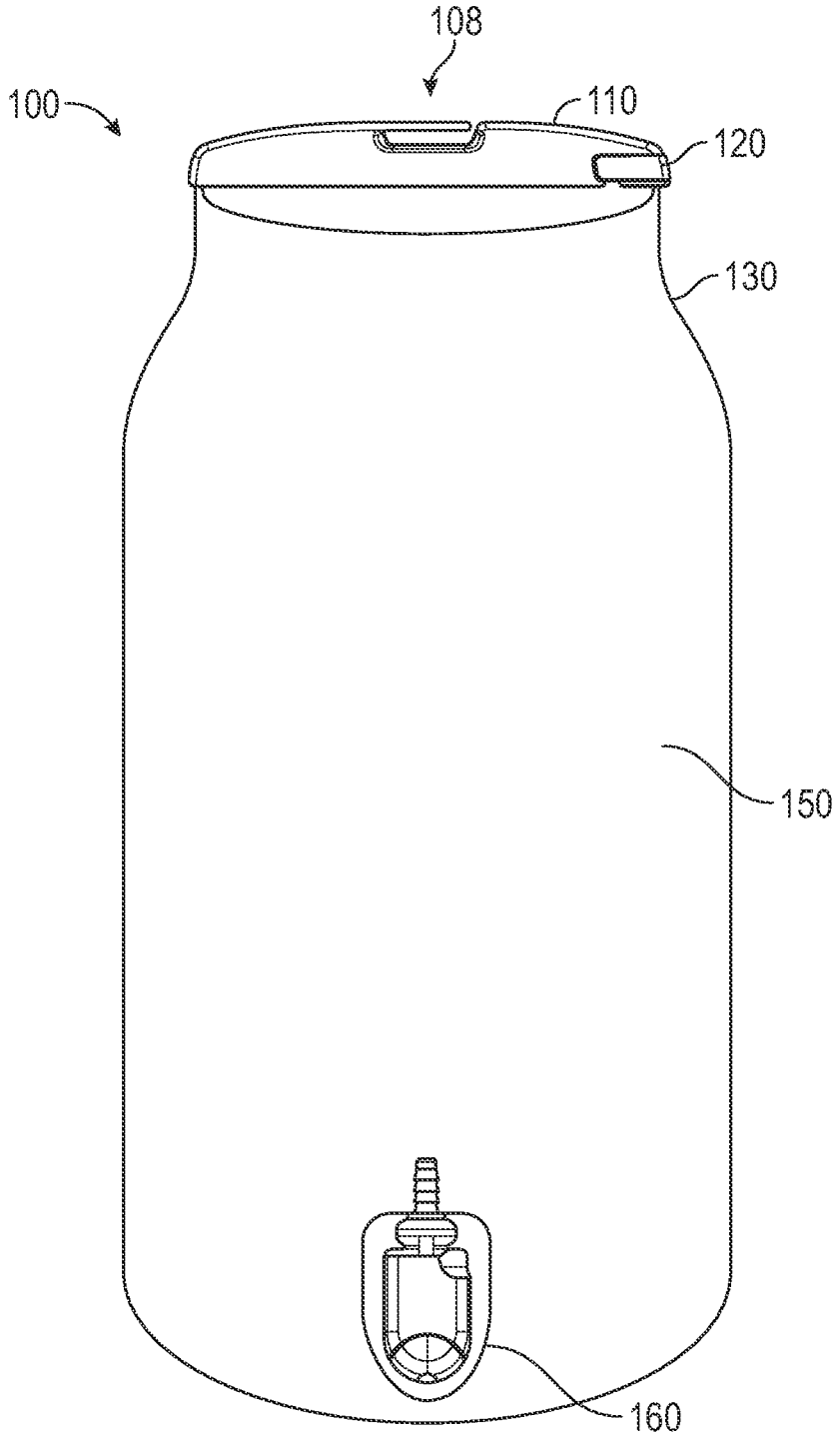
FIG. 1 shows an exemplary bladder having an upper opening sealed with a closure.

As can best be seen in FIG. 1, a bladder 100 can be used to hold water or other liquids. The bladder 100 can be made of plastic or another flexible material. The bladder 100 can have an upper opening for pouring, drinking, or filling with liquid. The upper opening can be sealed with a closure 108 as described herein. The closure, or sealing mechanism, 108 can comprise a closure frame 110, a bottom front plate 130, a top front plate (not pictured), and a trigger or closure lock 120. Bladder 100 features thin-walled container with open top 150. A front sheet and a rear sheet can be sealed together around a perimeter except for the open top. Bladder 100 can include a lower exit port 160 for connecting a fluid transfer tube.

Figure 2:
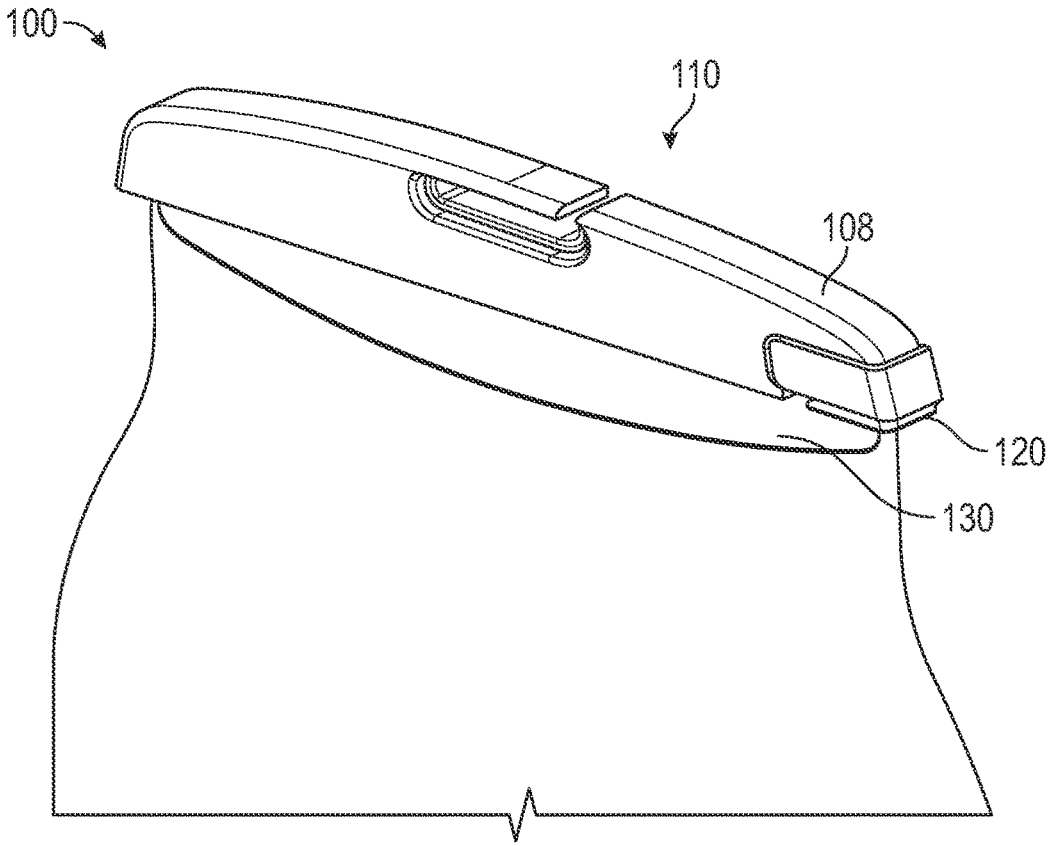
FIG. 2 is a perspective view of the closure mechanism.

FIG. 2 shows a perspective view of closure mechanism 108. Frame 110 captures bottom front plate 130 and folded over top front plate 140 while trigger 120 locks frame 110 to the bottom and top front plates by trapping the pins on the plates within notches in the frame.

Figure 3:
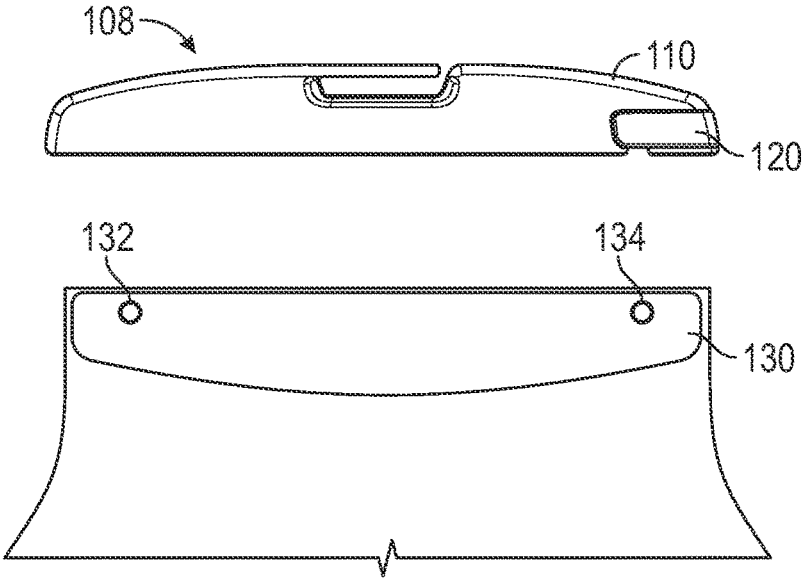
FIG. 3 is a side view of the closure mechanism.

In FIG. 3 closure 108 is partially assembled with frame 110 disengaged from the folded top front plate (not shown) and bottom front plate 130. Bottom front plate 130 includes first pin 132 and second pin 134 on opposite sides.

Figure 4:
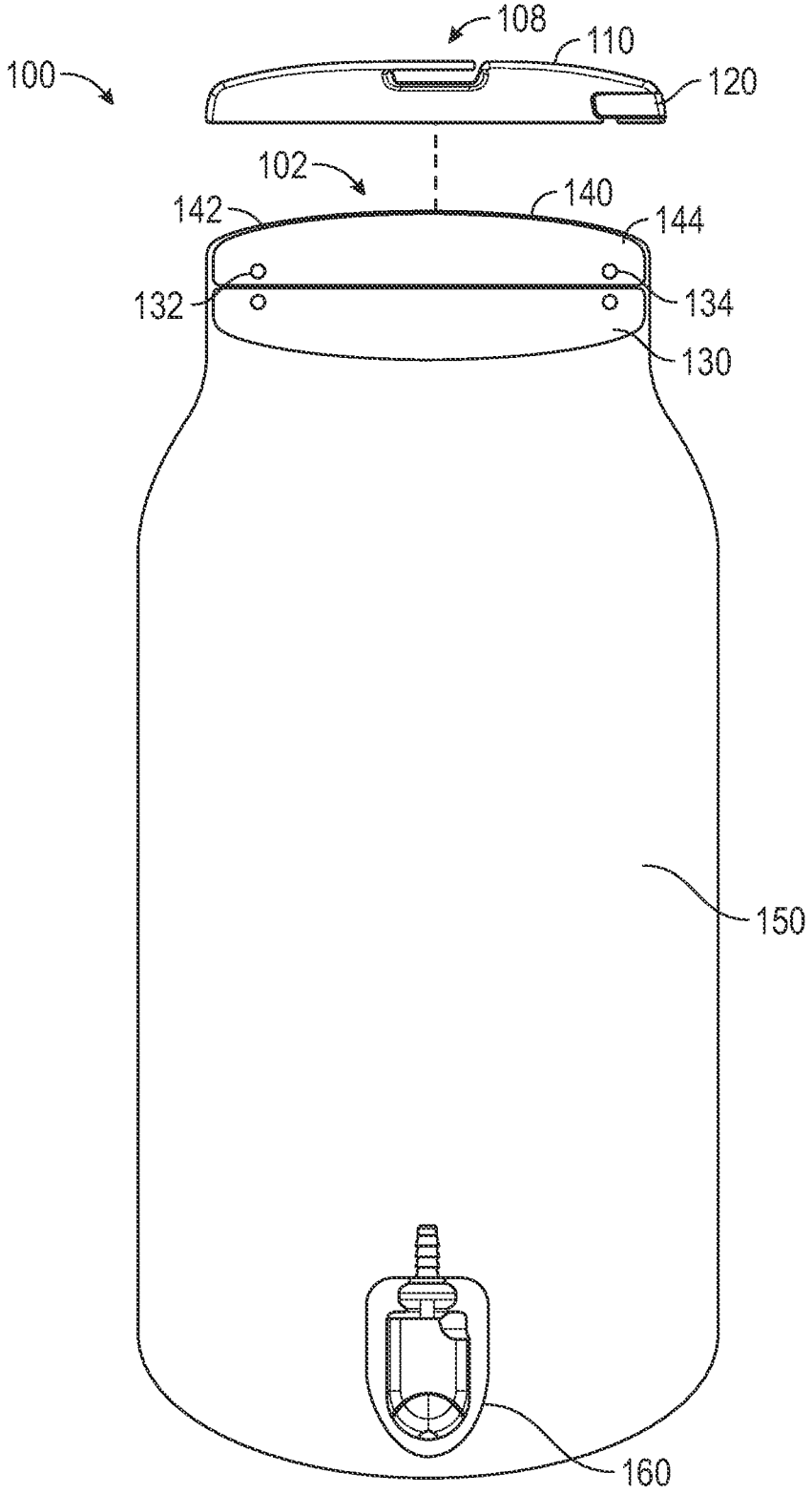
FIG. 4 shows the bladder with the top opening in an unfolded open position and the closure removed.

FIG. 4 shows bladder 100 with top opening 102 in an unfolded open position. Top front plate 140 and bottom front plate 130 are coupled to the front sheet of the bladder adjacent to each other. All four pins 142, 132, 134, 144 face frontward/outward on the top and bottom front plates. Closure 108 is separated from bladder 100. A folding crease line can be defined between the two front plates.

Figure 5:
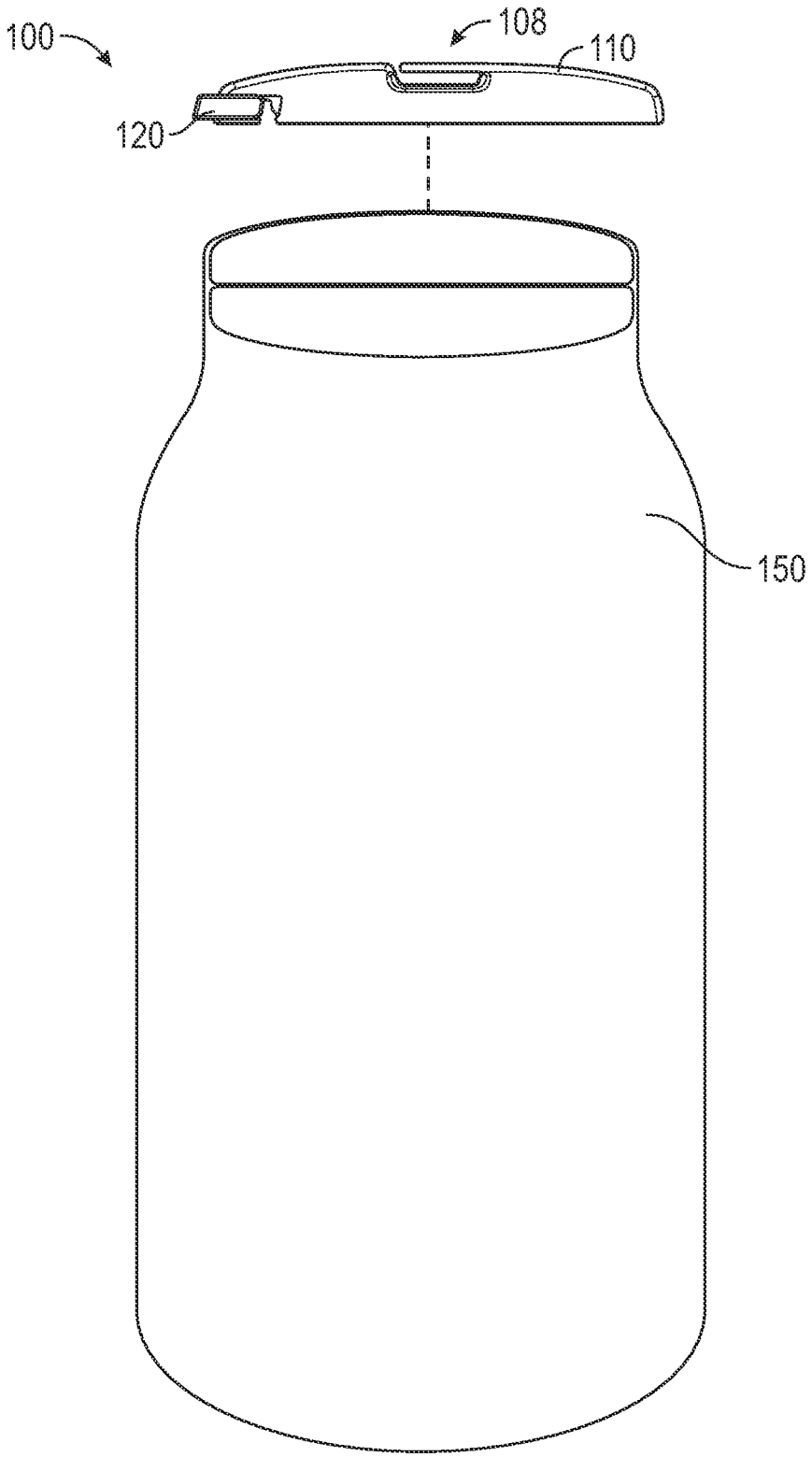
FIG. 5 shows a back view of the bladder in the open position with the closure removed.

FIG. 5 shows a back view of bladder 100 in an open position with closure 108 removed.

Figure 6:
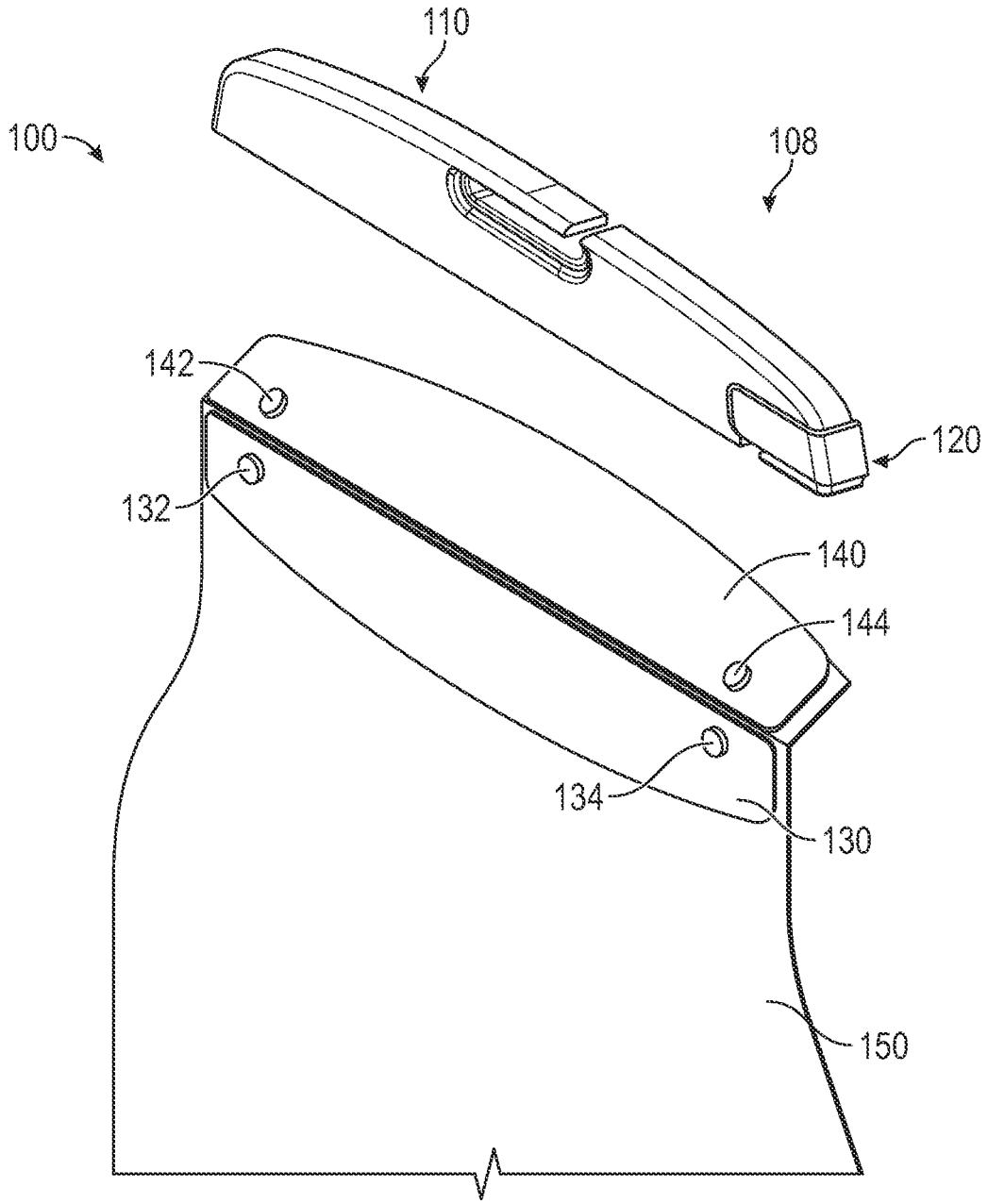
FIG. 6 is a perspective view of the upper opening of the bladder partially folded.

FIG. 6 shows bladder 100 with bladder top edge partially folded at a crease line between the top edge of bottom front plate 130 and bottom edge of bottom front plate 140. Bottom front plate 130 and top front plate 140 are shown as separate elements, but can be a single plate attached to the bladder in some embodiments, featuring a living hinge at the desired fold location.

Figure 7:
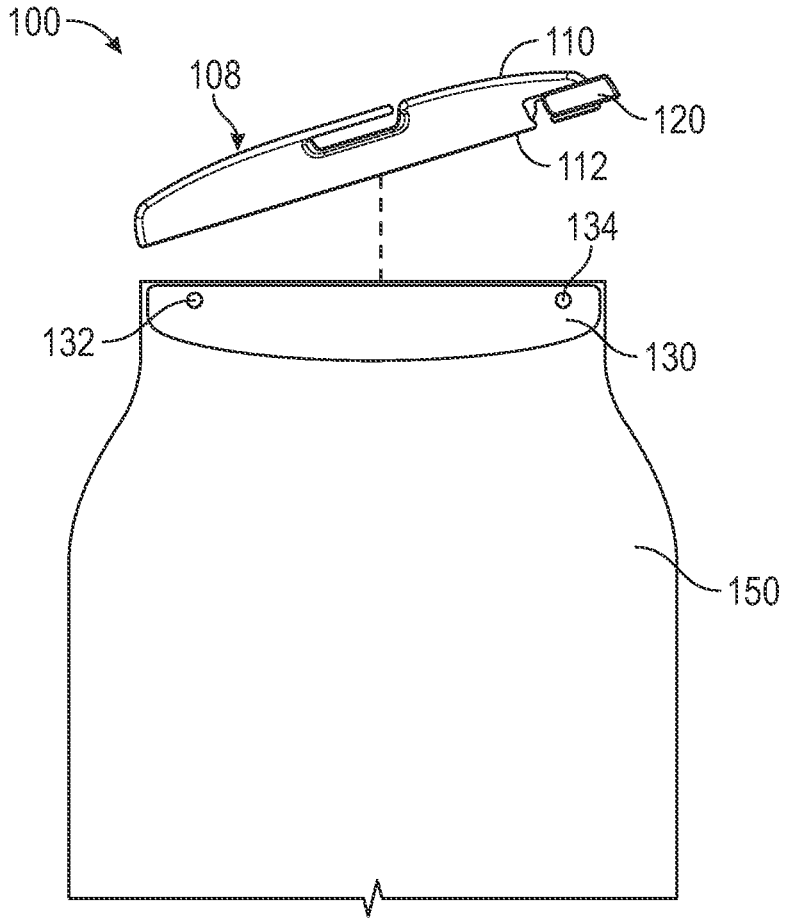
FIG. 7 shows the closure positioned for loading over the folded top opening.

In FIG. 7, closure 108 is positioned for loading/attachment over folded top front plate 140 and bottom front plate 130. Trigger 120 is in the open position exposing pin slot 112.

Figure 8:
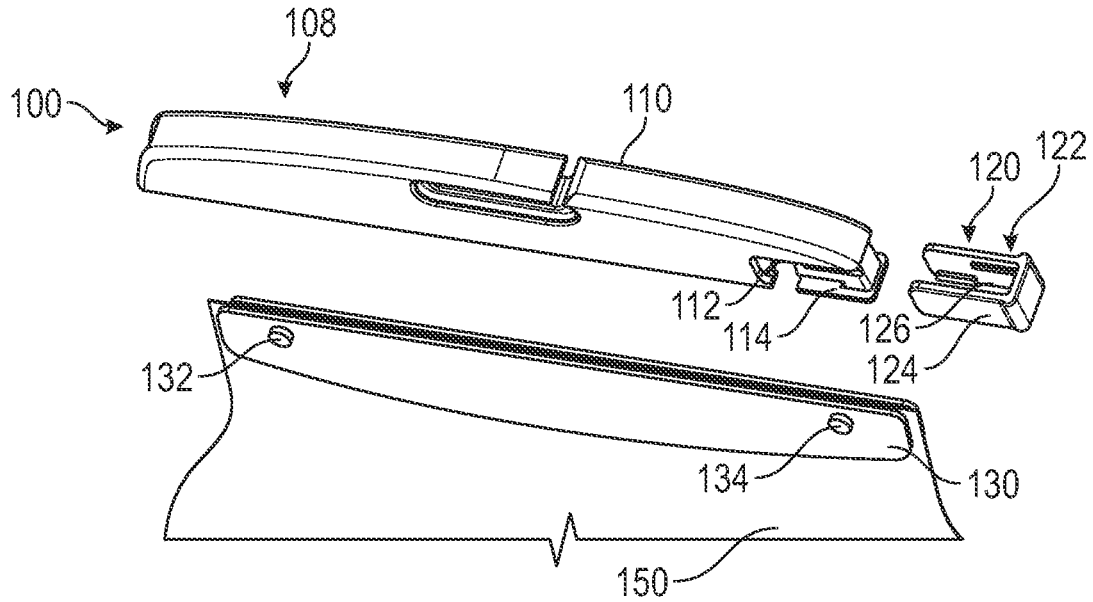
FIGS. 8 and 9 are exploded view of the closure.

FIG. 8 depicts an exploded view of closure 108 and shows pin slot 112 and locking rib slot 114. Trigger 120 features side members 122 and 124 and locking rib 126, which rides in the rib slot 114.

Figure 9:
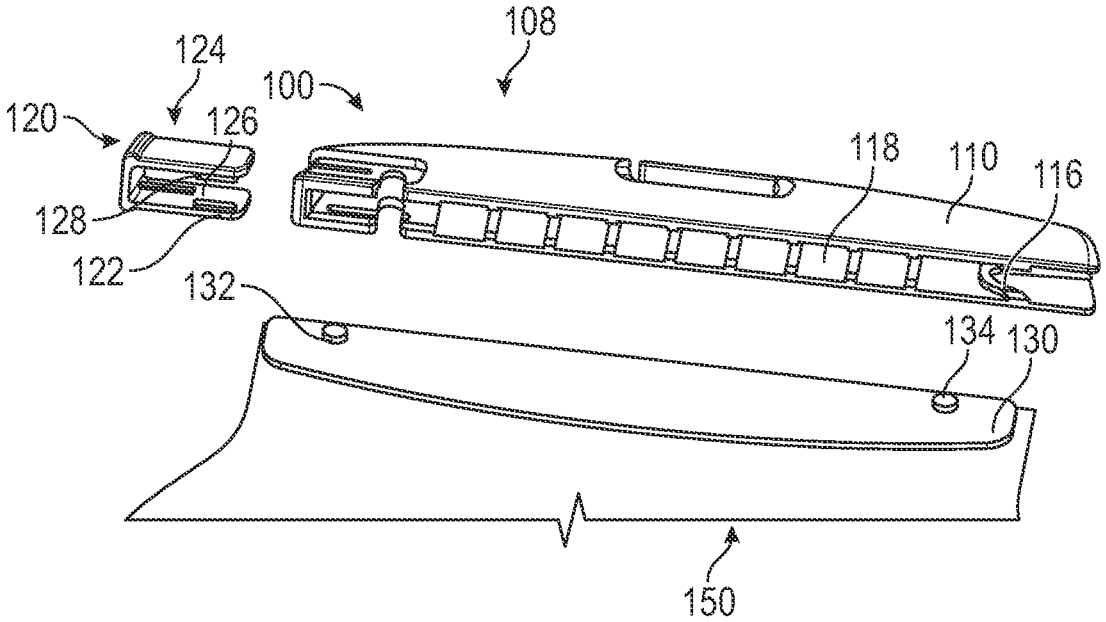

FIG. 9 shows the exploded view of closure 108 from another angle. Pin slots, or channels, 116 are on the opposite end of frame 110 from pin slots 112. The internal channel 118 extending across the closure frame is sized to receive and compress top front plate 140 and bottom front plate 130 along with the folded bladder therebetween such that a seal is formed at the fold line. Trigger 120 can include locking ribs 126 and 128, which can be molded in opposition to each other on trigger 120 side members 122 and 124.

Figure 10:
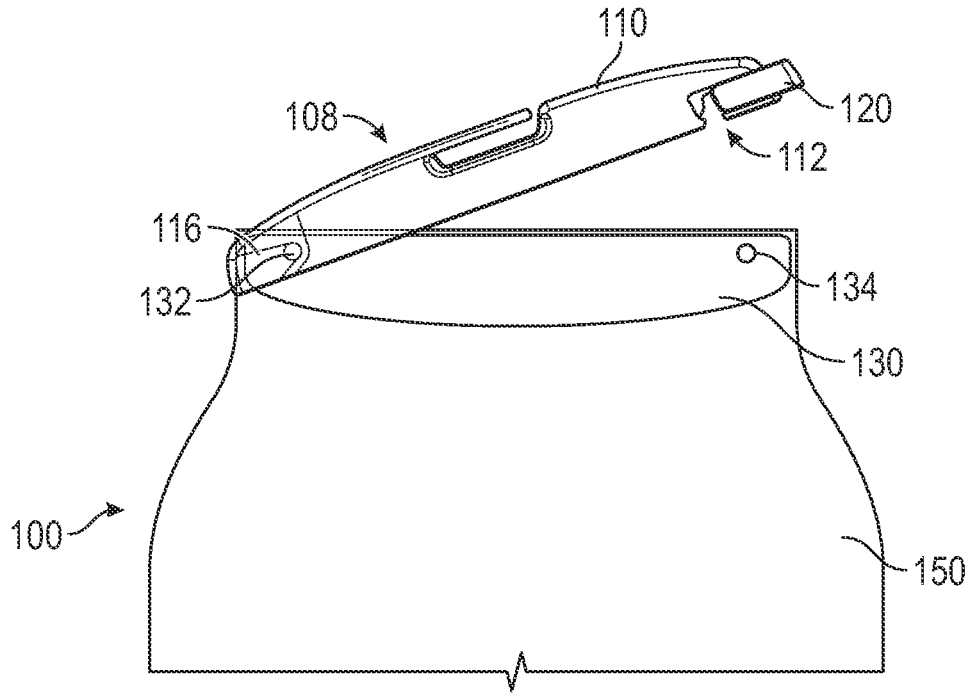
FIG. 10 shows the closure engaged with one end of the folded top opening.

FIG. 10 shows closure 108 engaged with the folded front plates with the folded front plates inserted into frame 110. Pin 132 is captured within pin channel 116 and trigger is in the open position. Pin channel is designed to capture pin 132 and allow closure 108 to pivot to fully capture top front plate 140 and bottom front plate 130.

Figure 11:
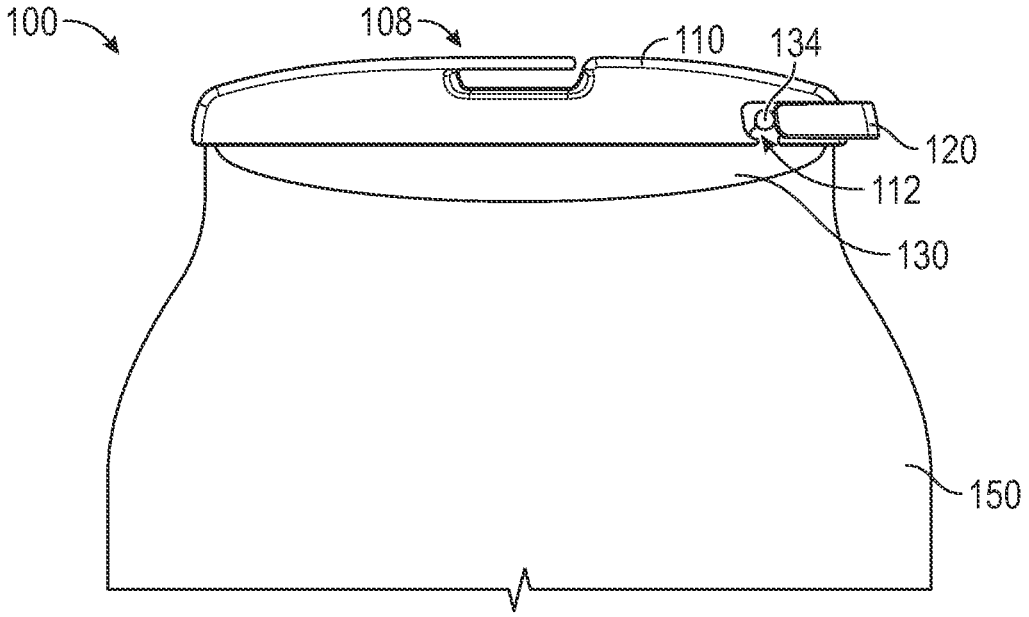
FIG. 11 shows the closure fully inserted over the folded top opening.

In FIG. 11 closure 108 is fully inserted over the folded front plates, pin 132 on the front side and pin 142 on the back side are captured within closure channel 108. Pins 134 and 144 are loaded within pin slot 112. Trigger 120 is in the open position, ready to be pushed inward to lock pins 134 and 144 to closure 108.

Figure 12:
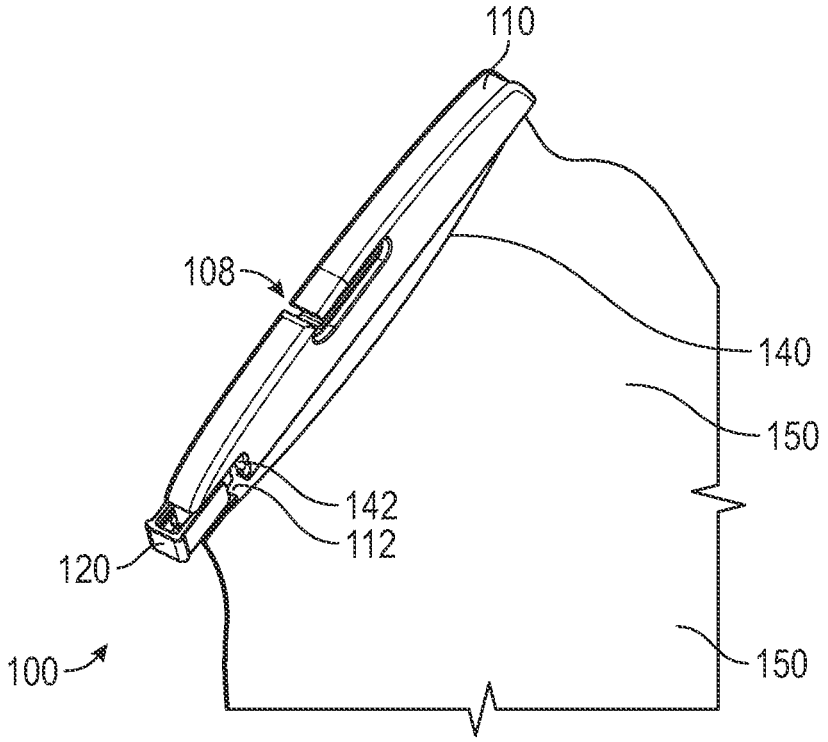
FIG. 12 is a perspective view of closure in the engaged and ready to lock position.

FIG. 12 shows a perspective view of closure 108 in the engaged and ready to lock position.

Figure 13:
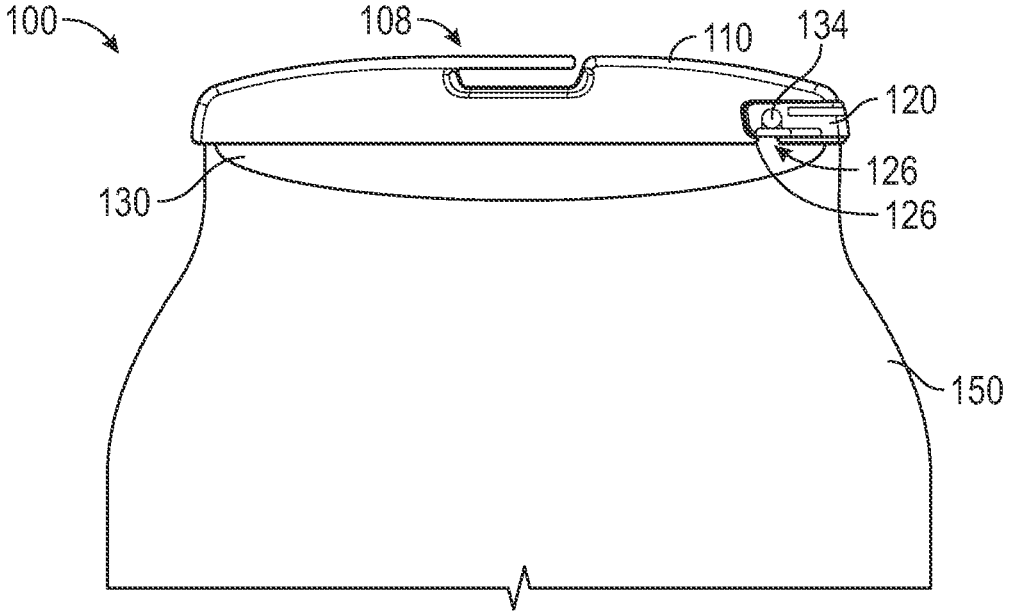
FIG. 13 is a front view of the closure in its sealed position.

FIG. 13 shows a front view of closure 108 in its sealed position. Trigger 120 has been slid inward so that lock ribs 126 and 128 (not shown) block pin slot 112. Closure 108 is locked to the folded front plates and compresses them together such that a seal is formed at the fold line.

Figure 14:
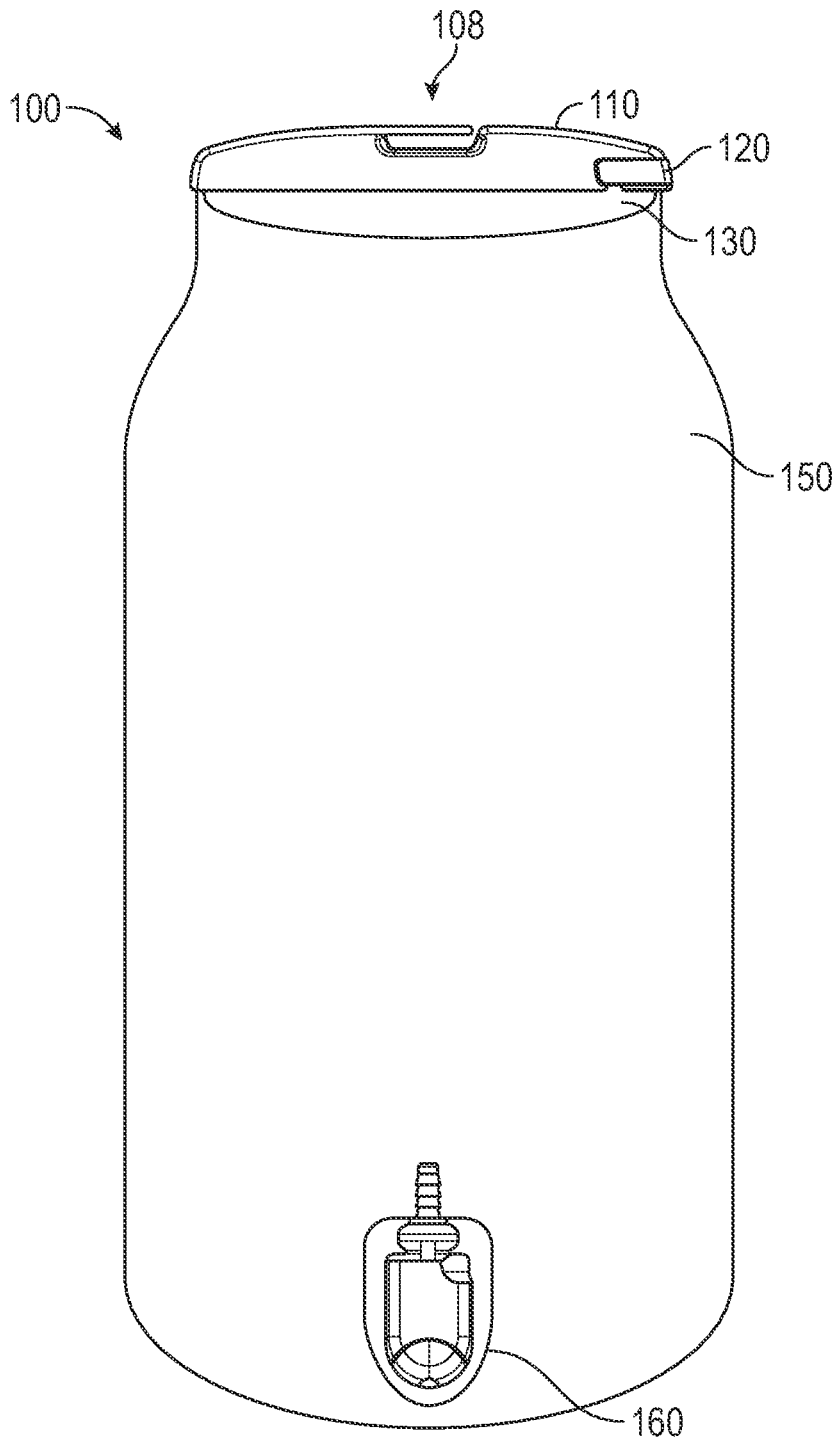
FIG. 14 is a full front view of bladder with closure in the sealed state.

FIG. 14 depicts a full front view of bladder 100 in a sealed state.

Figure 15:
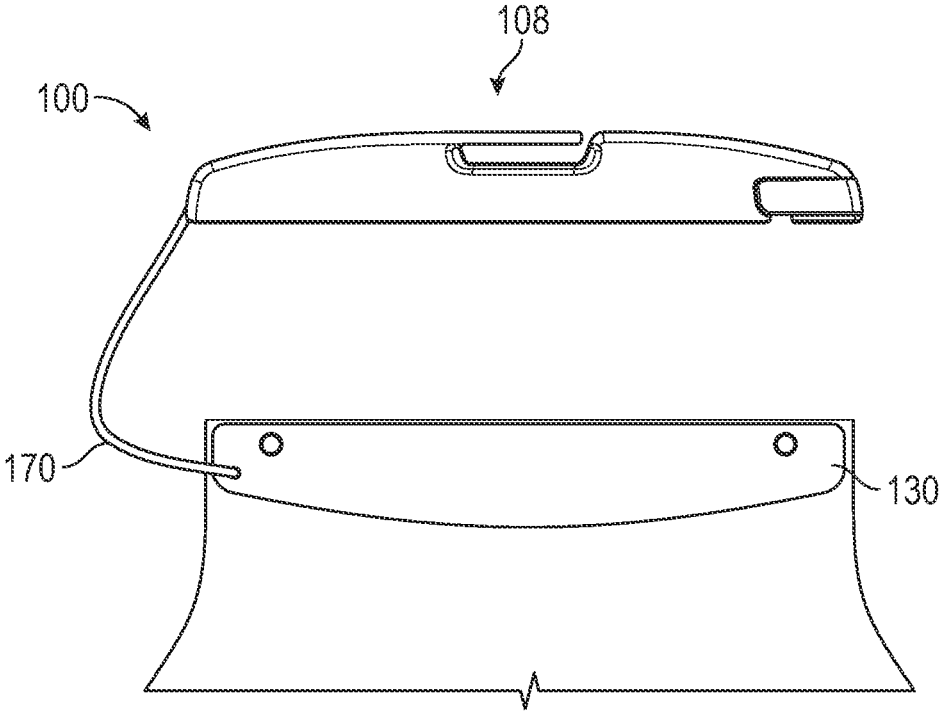
FIG. 15 shows an exemplary closure that is attached to the bladder top opening via a tether.
Figure 16A:
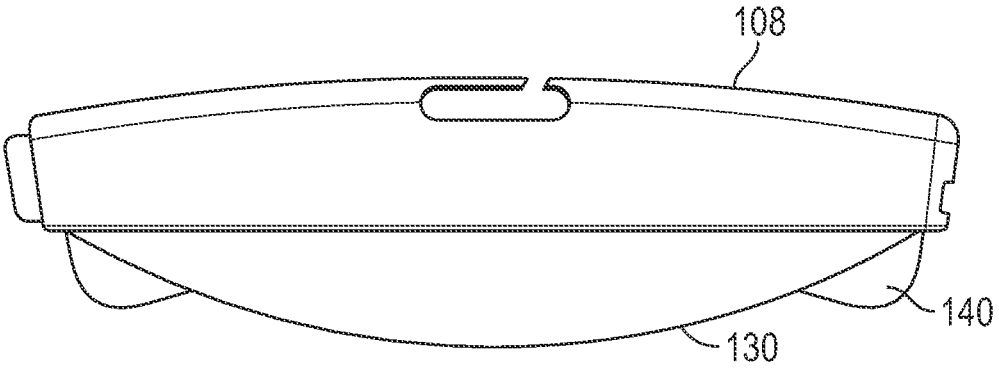
FIG. 16A-16D show various views of another exemplary closure, which includes an internal spring-loaded trigger.
Figure 16B:
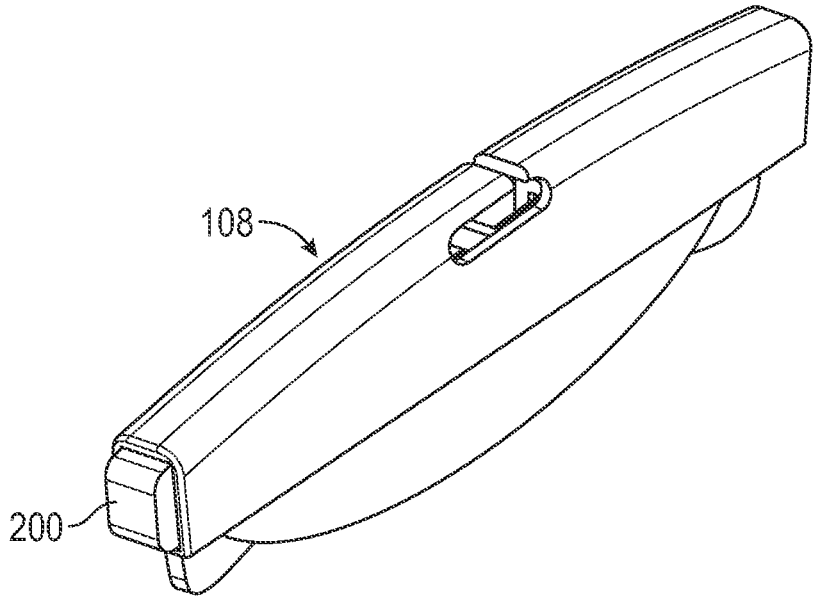
Figure 16C:
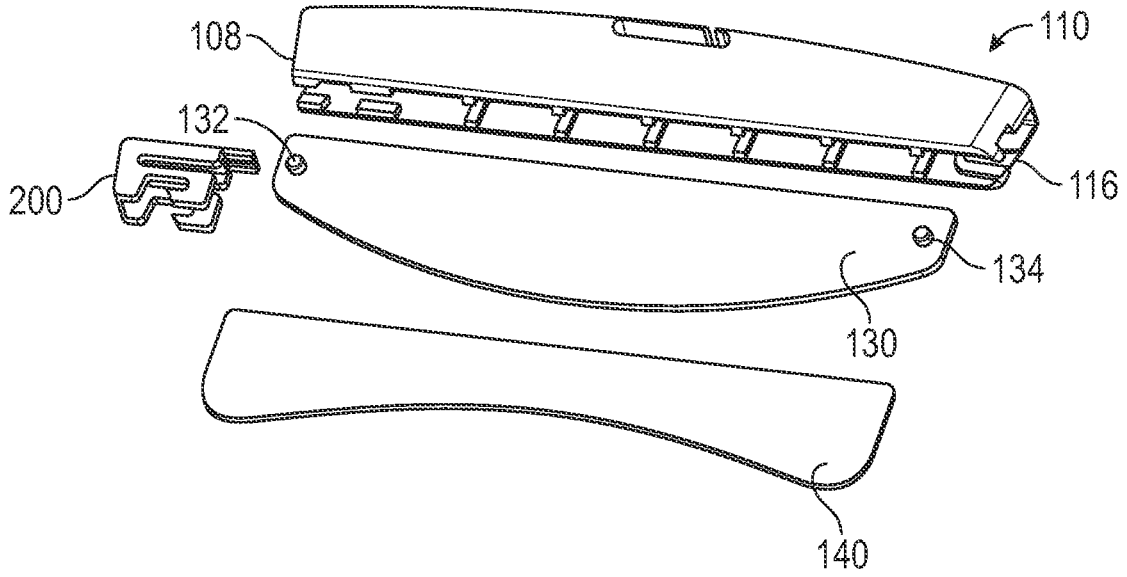
Figure 16D:
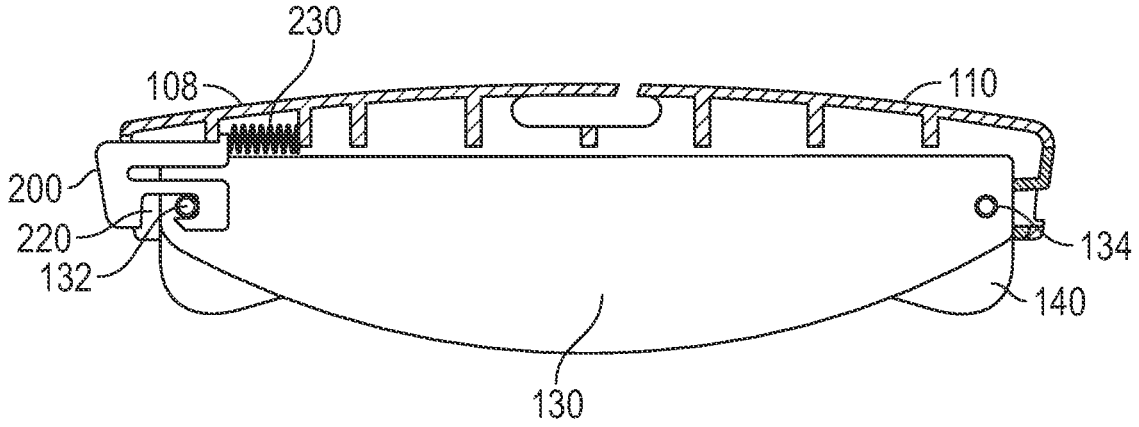

FIG. 15 features closure 108 attached to bottom front plate 130 via tether 170.

FIG. 16A-16D shows various views of an alternate embodiment of closure 108. Closure 108 in this version includes internal spring-loaded trigger 200. Spring-loaded trigger 200 pin slot 220 and compression spring 230. In this embodiment, pin slot 220 is designed such that trigger 200 will deflect against spring 230 as pin slot 220 comes in contact with pins 132 and 142 (not shown), As a result, closure 108 will automatically lock onto the folded top plates as closure 108 is pivoted onto the folded plates.

In addition, the edges of the bladder and/or the plates can be curved or otherwise non-straight to provide distinction between the overlapping edges so that they can each be more easily grasped or manipulated to open/close/fold them.

Figure 17:
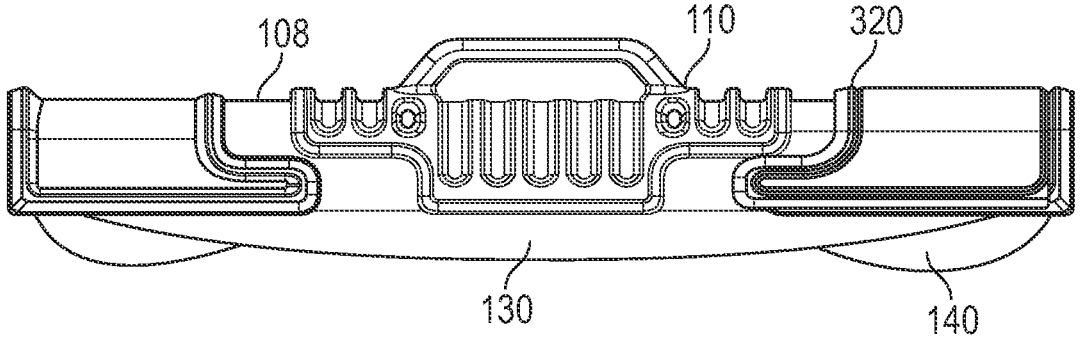
FIG. 17 shows another exemplary closure.

FIG. 17 shows another embodiment of closure 108. In this embodiment, trigger 320 is designed to wrap over the top of frame 110.

Figure 18:
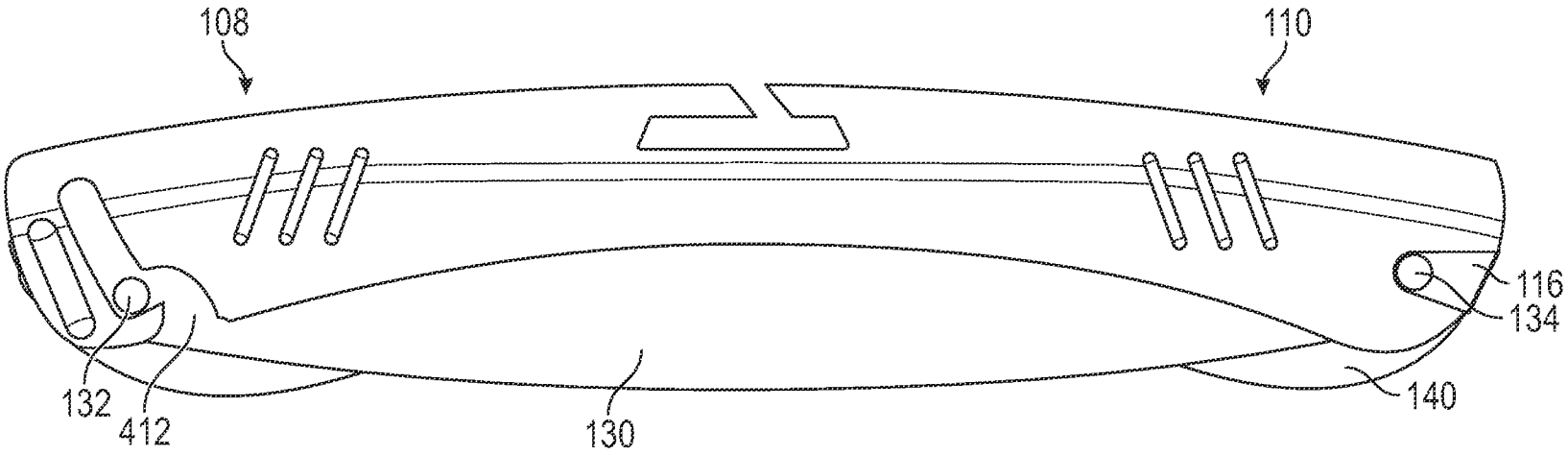
FIG. 18 shows yet another exemplary closure.

In FIG. 18, trigger 420 is integrated into the body of frame 110 such that pin 132 is automatically captured when closure 108 is rotated to capture the folded top plates. To release closure 108, trigger 420 is pushed outward.

Figure 19:
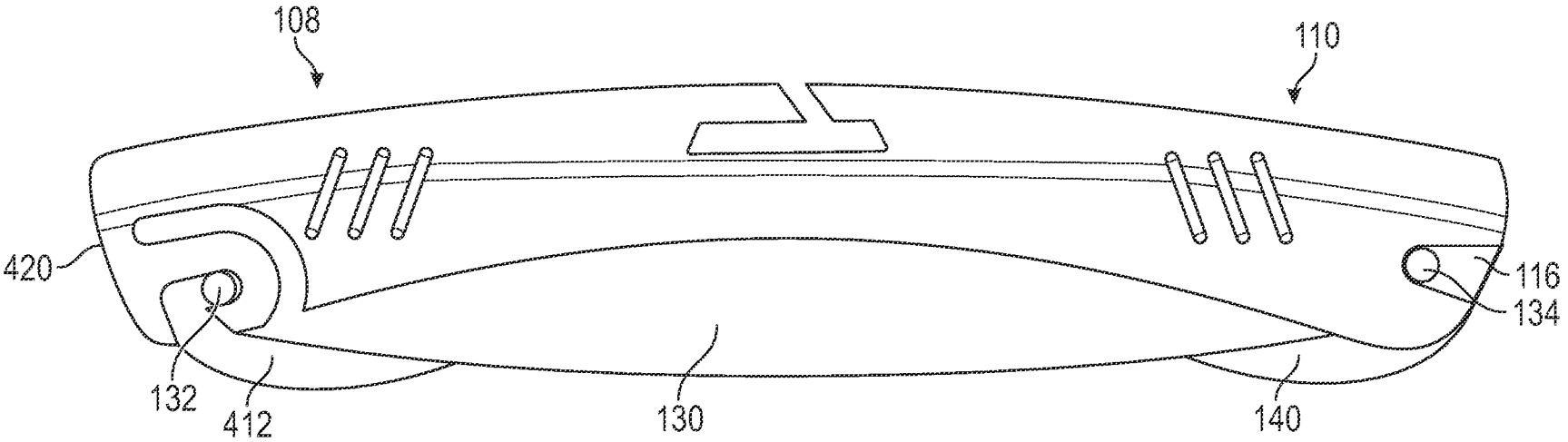
FIG. 19 shows still another exemplary closure.

FIG. 19 shows an embodiment similar to FIG. 18. In this case, release of closure 108 is achieved by pulling trigger 420 inward.

Figure 20A:
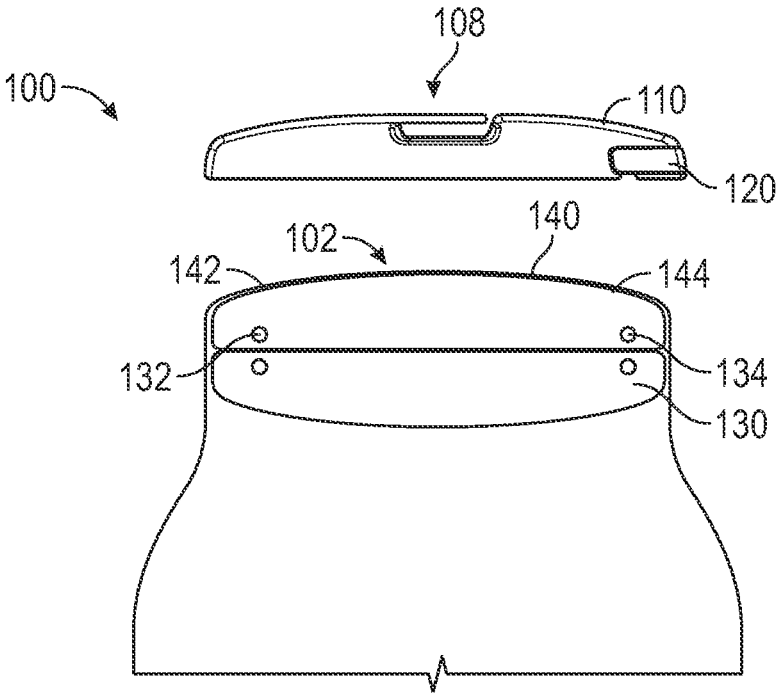
FIGS. 20A and 20B are front and back views of the bladder and enclosure of FIGS. 1-14.
Figure 20B:
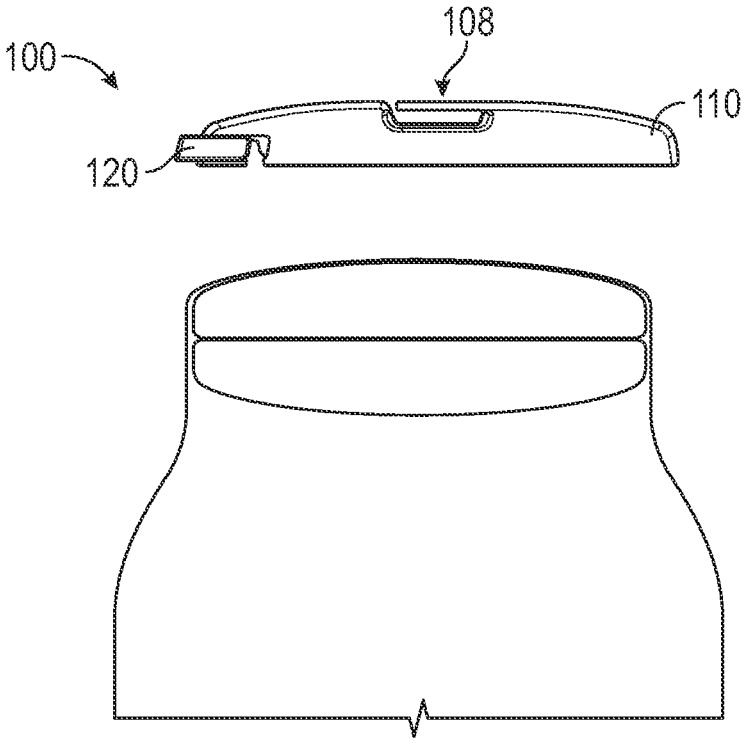

FIGS. 20A and 20B show a front and back view of bladder 100 and enclosure 108.

Figure 21A:
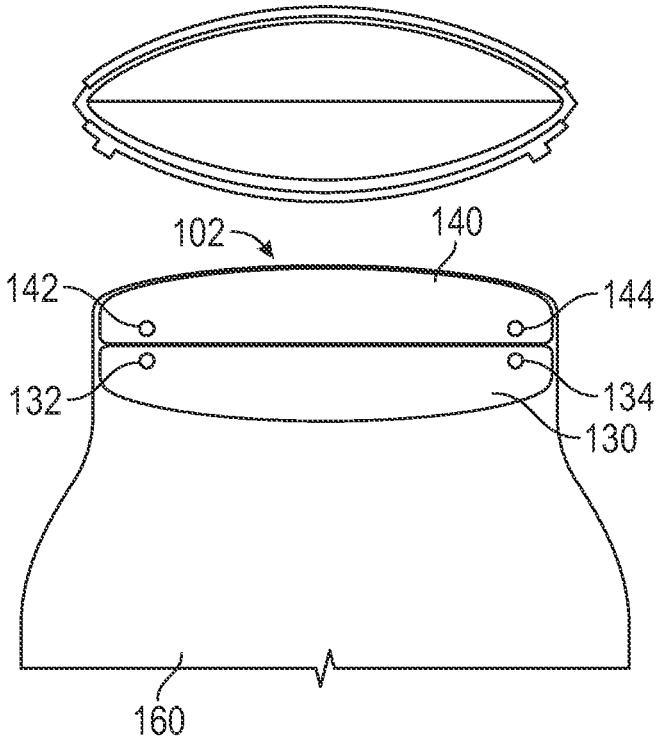
Figure 21B:
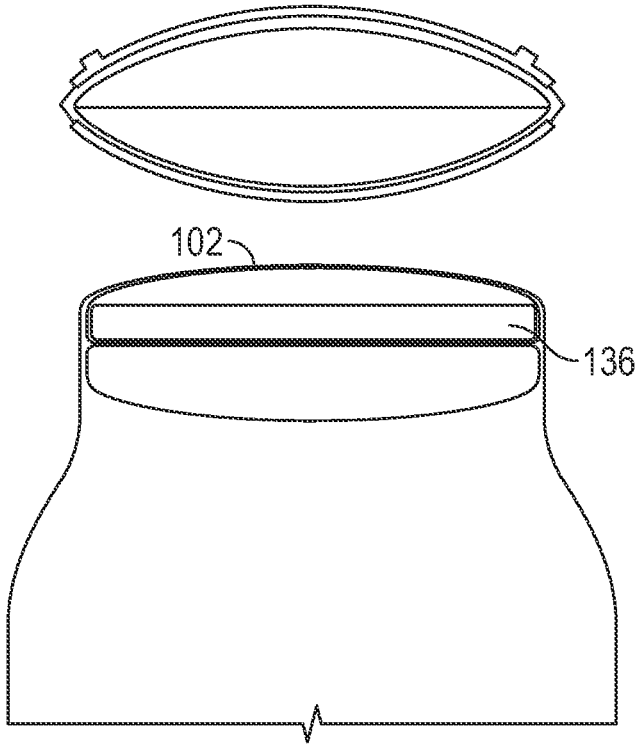

FIGS. 21A and 21B show the top and front and back views of the bladder portion of bladder 100. In this embodiment top front plate 130 and bottom front plate 140 are formed such that they take a convex form when not in a folded and captured position. In FIG. 21B, an additional back plate 136 is attached the opposite side of the bladder (e.g., the rear sheet) from top front plate and bottom front plate. Back plate 136 may also be pre-formed to take a bowed or convex form. As a result, when closure 108 is removed, top front plate 130 and/or bottom front plate 140 in combination with back plate 136 deflect outward to hold bladder top opening 102 in an open position. Top front plate 130, bottom front pate 140, and back plate 136 may be constructed from a plastic and molded or formed such that they are biased towards a bowed shape that helps draw the bladder top into an open position in the absence of closing forces, Top front plate 130, bottom front pate 140, and back plate 136 may include a spring member that is biased towards drawing the bladder top into an open position in the absence of closing forces. Top front plate 130, bottom front pate 140, and back plate 136 may be constructed such that they are deformable and can be manipulated to temporarily hold the bladder top in an open position.

Figure 21C:
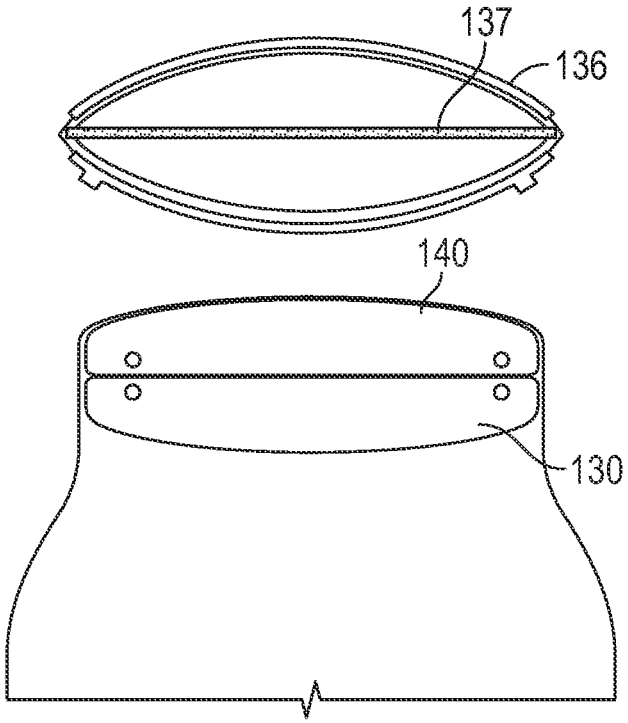
FIG. 21C shows an exemplary bladder having a top opening that includes a tension member connected at opposite side seams.

In the embodiment shown in FIG. 21C the bladder top can also include a tension spring member 137 spanning across the opening and connected at opposite side seams such that the tensile force exerted pulls the ends together and causes the front and back plates to bow outwards drawing the bladder top to an open position in the absence of closing forces. Spring member 137 may be constructed of an elastic material that can stretch when the bladder top is flattened for closing.

In any of the herein disclosed embodiments, and additional sealing member can be coupled to the rear sheet at the level of the lower front plate 130 or the upper front plate 140, such that the sealing member becomes sandwiched between two layers of the rear sheet, and between the two front plates, when they are folded into the closed position by further pressing the sheet material against the plates. The sealing member can help prevent any leakage channels when the upper opening is closed. In some of these embodiments, rear surfaces of the one or both of the front plates can have concavities that are sized to partially receive the extra thickness of the sealing member when the sealing member is sandwiched between the two front plates, further helping to seal the upper opening.

Figure 22:
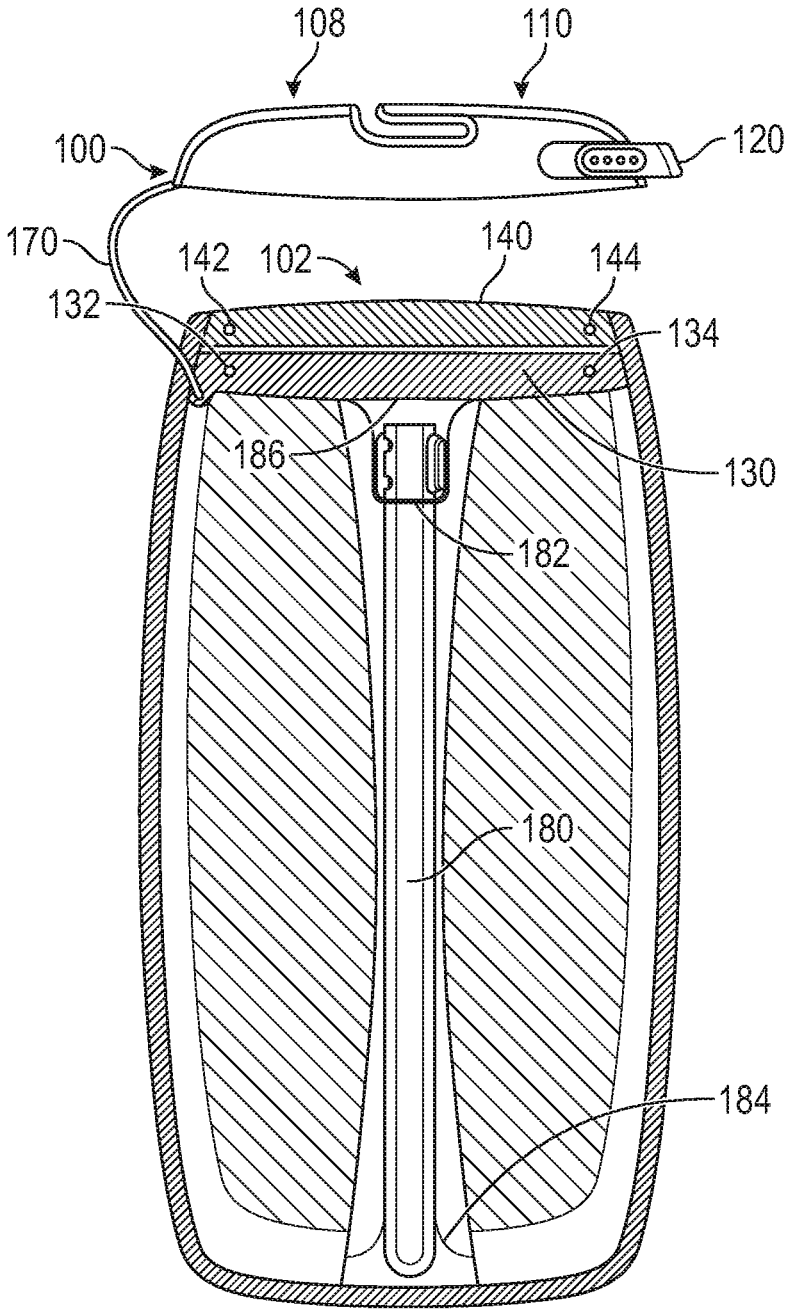
FIG. 22 shows another exemplary bladder having a rigid handle along with a top opening with a closure.

FIG. 22 depicts bladder 100 with handle 180. Handle 180 includes integrated quick connector 182, bladder exit port connection 184, and bottom front plate connection 186. Handle 180 can include a fluid transfer channel bored into handle 180 or a drink tube that sits within a channel on the back side of handle 180.

Figure 23A:
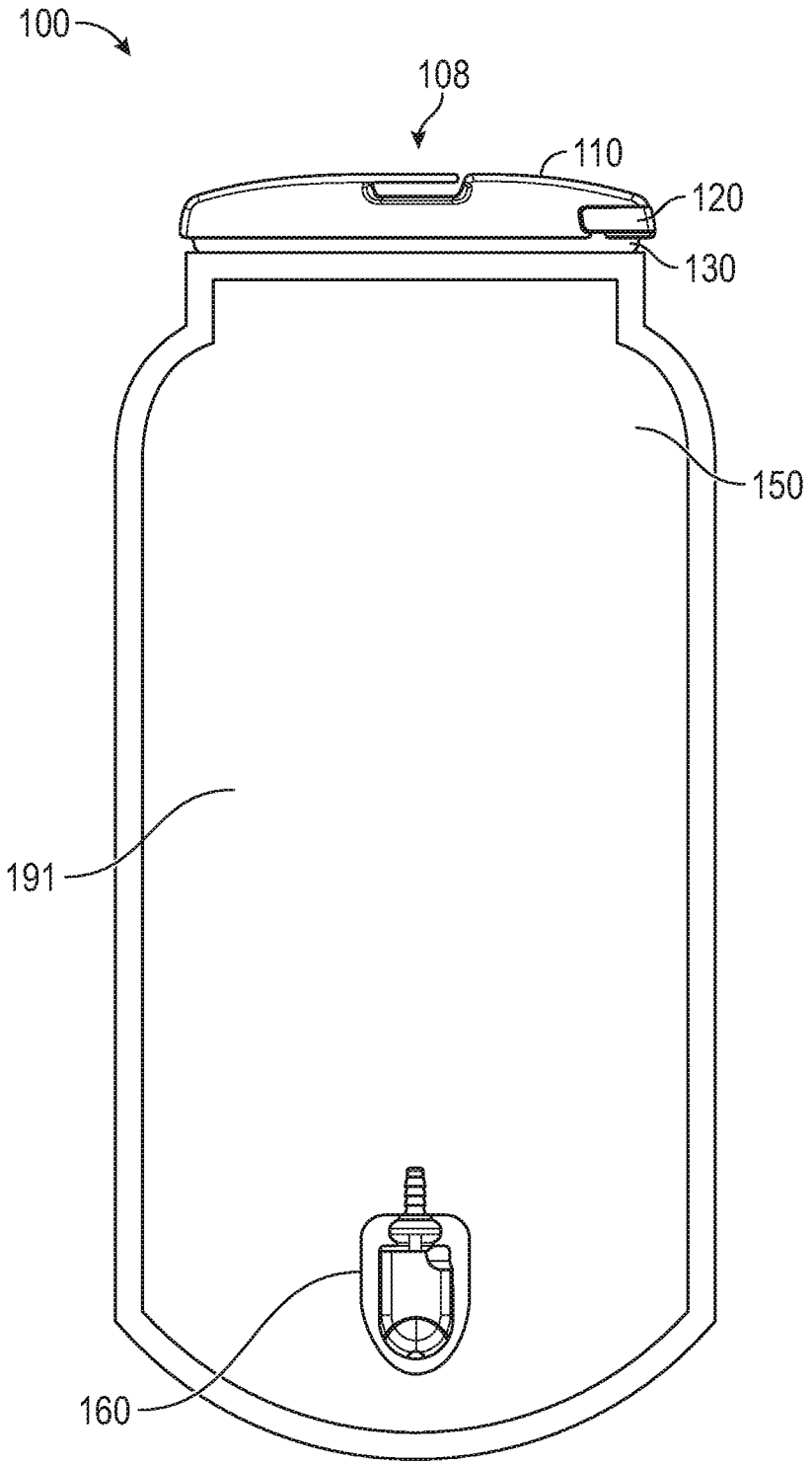
FIGS. 23A and 23B show a front and side view of an insulated bladder with a top opening closure.
Figure 23B:
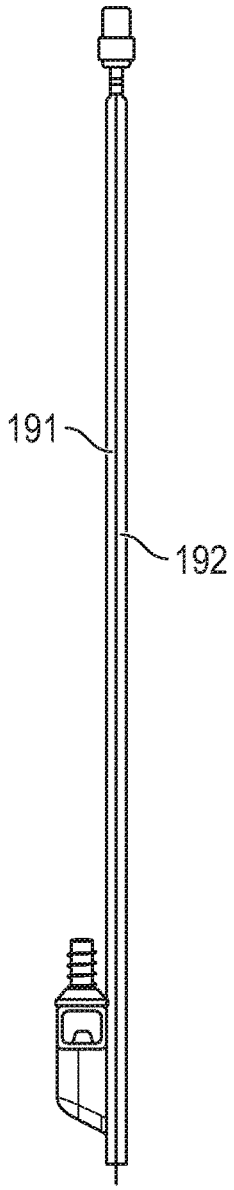
Figure 23C:
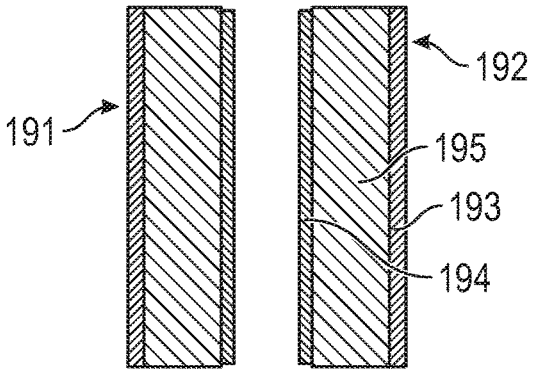
FIG. 23C is a partial cross-sectional view of insulated bladder walls.

FIGS. 23A and 23B show a front and side view of an insulated version of bladder 100. Insulating layers 191 and 192 cover the front and back of bladder 100. Insulating layers 191 and 192 can be laminated to bladder 100 via adhesive, welding, or encapsulation. FIG. 23C shows a cross-section of the preferred insulating material for insulating layers 191 and 192. The bladder walls can include an outer reflective layer 193, an insulating foam layer 195, and bladder film layer 194.

Figure 24A:
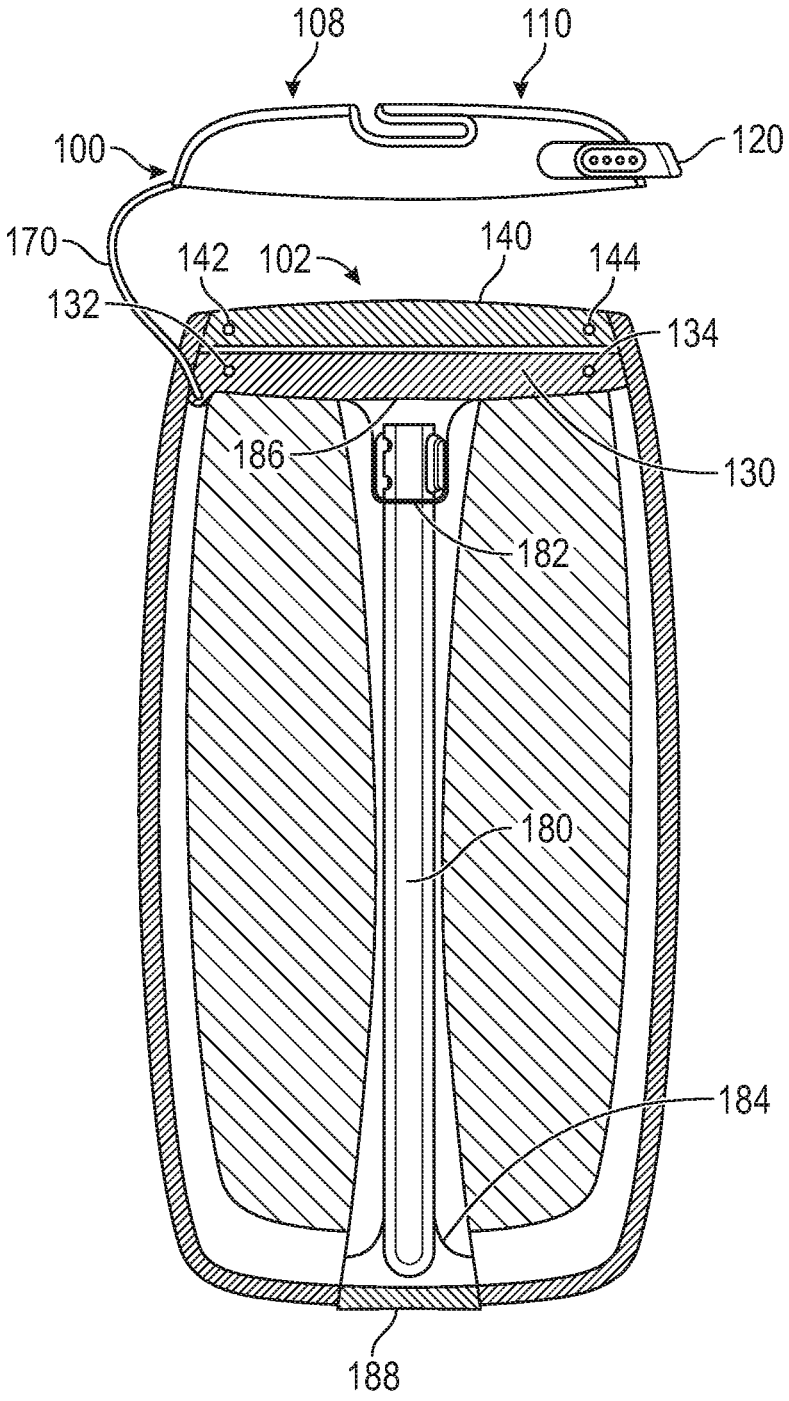
FIGS. 24A and 24B are front and side views of an exemplary top closure bladder having a rigid handle and a handle base that wraps around the base of bladder.
Figure 24B:
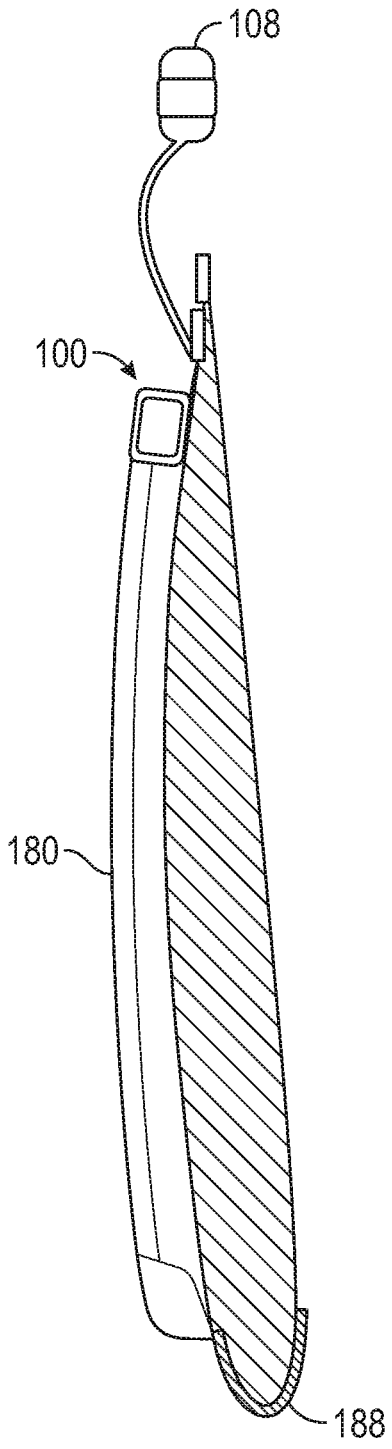

FIGS. 24A and 24B show a front and side view of bladder 100 featuring handle 180 and handle base 188, where handle base 188 wraps around the base of bladder 100 and is attached to front and back sides of bladder 100.

Flexible Fluid Reservoirs with Structural Members

Disclosed herein are embodiments of flexible fluid reservoirs that may include a front sheet and a rear sheet that may be fully or partially sealed around their mutual perimeters to form a bladder. In some embodiments, the front and/or rear sheet may be formed to create a 3-dimensional shape. The reservoirs may include at least a first fluid port in an upper portion of the reservoir and at least a second fluid port in the upper or a lower portion of the reservoir. The first fluid port may be relatively larger than the second port and can be used to fill the reservoir with fluid and/or solids (e.g., ice), dispense the contents from the reservoir, and/or to clean the reservoir by inserting objects into the reservoir. The first port can be sealed to the front or rear sheet or consist of an opening between the front and rear sheets that can be sealed in some fashion. The second port can be used as an exit port, such as by coupling the exit port to a tube and/or outlet valve. The second port can be sealed to the front or rear sheet or sealed in-between front and rear sheets. The embodiments can include one or more internal baffles that attach to front and rear sheets that limit the reservoir's expansion and shape it in a predetermined way.

Some embodiments of the reservoir can include a flexible reservoir with at least one port and front and rear sheets that are connected by one or more baffles. In some embodiments the reservoir may include baffle elements along with rigid elements that act to separate the reservoir walls from each other. In other embodiments, the reservoir can include the rigid elements, but no baffles.

In a preferred embodiment a rigid element is spaced close to and in parallel with a baffle element. The baffle is welded to the front and rear sheet while the rigid element is welded only to the rear sheet. The rigid element is welded to the rear sheet via a living hinge arrangement allowing the rigid element to stand up or lay flat within the reservoir. The baffle's height is such that front and rear sheet displacement relative to each other is limited. The rigid element height is equal to or slightly greater than the baffle element height resulting in tight fit when the rigid element is in the standing position. This arrangement allows the reservoir user to lay the rigid element flat during reservoir use and to stand the rigid element up to aid reservoir drying.

In a second embodiment, a foldable rigid element is designed to act as both baffle and drying aid. In this design, a rigid element featuring a longitudinal hinge is welded to the front and rear sheets. The hinge is designed so that the foldable rigid element is normally in a folded configuration allowing the reservoir walls to collapse inward as fluid is drained. For drying the hinge is straightened slightly beyond normal so that the heels of the upper and lower folding halves of the foldable rigid element meet, creating a relatively stable standing rib within the reservoir to aid drying. Tabs attached to the outside of the reservoir may be included to help pull the reservoir walls away from one another and to deploy the foldable rigid element.

Baffles are used to limit reservoir ballooning when the reservoir is filled with fluid. As described above they can also be used to temporarily hold the reservoir walls apart during drying. Baffles can also be used to influence the cross-sectional shape of the reservoir. For instance, an s-shaped longitudinal baffle can be employed to give the reservoir an s-like curve when full. A shaped baffle may be used in a standard reservoir with flat front and rear sheets. In other embodiments, the front and/or rear sheet may be formed in a 3-D shape itself that works with the shaped baffle to impart a desired shape to the reservoir. Front and rear sheets may be 3-D formed using a multi-panel, pinch welding, or heat/vacuum forming approach.

In some embodiments, rigid standing elements may be combined with shaped baffles to create reservoirs that are shaped and include integrated drying mechanisms. The rigid element systems described above can also be used in reservoirs that feature 3-D formed walls and/or shaped baffle designs.

In another embodiment, the baffle may be a constructed to act as a spring against the reservoir walls, keeping the front and back reservoir walls apart from one another when the reservoir is empty, yet offering sufficient compliance such that the reservoir can collapse on itself as it drains. Spring-like baffles can be created via the material properties, shape, and/or placement of the baffle pieces within the reservoir. These baffles act to both hold the reservoir in an open shape for drying and also limit reservoir expansion depth as the reservoir is filled. Spring baffles can also be constructed to help shape a reservoir in a 3-dimensional manner. The spring baffle may vary in height, thereby limiting reservoir expansion depth by differing degrees along the baffle's length. Multiple spring baffles may be employed to shape a reservoir as it expands and/or control a reservoir's 3-D profile when empty.

To provide the force necessary to hold apart the reservoir walls, the spring baffle may be pre-formed, constructed of a less-flexible material than the bladder, thicker, and/or pleated in some fashion.

In another embodiment, an internal baffle may be combined with one or more spring members attached to the reservoir walls such that the reservoir walls are naturally held apart from each other. In this case, it is advantageous to position the spring members near the opening of the reservoir to aid filling of the reservoir as well as drying. For a top fill reservoir, first and second arced spring members may be attached to the reservoir wall and positioned opposite one another near the reservoir opening. The spring members would assume their pre-formed shapes and hold the reservoir open in the absence of sealing forces. The spring members would be designed to allow use of a closure mechanism to seal the reservoir when needed. The spring members may be integrated into the closure mechanism. For example, the spring members could also act as fold plates in a closure mechanism where the reservoir top is folded over as part of the sealing process. The spring members can be designed to work with a variety of reservoir port closure types including, but not limited to; screw ports, flip cap ports, slide top ports, folded ports, and clamped ports.

In other embodiments, members or plates can be constructed from deformable or malleable material(s) so that they can be shaped to hold the reservoir in an open position. These can be incorporated within or on reservoir walls near the reservoir opening or other locations on the reservoir walls.

Figure 25A:
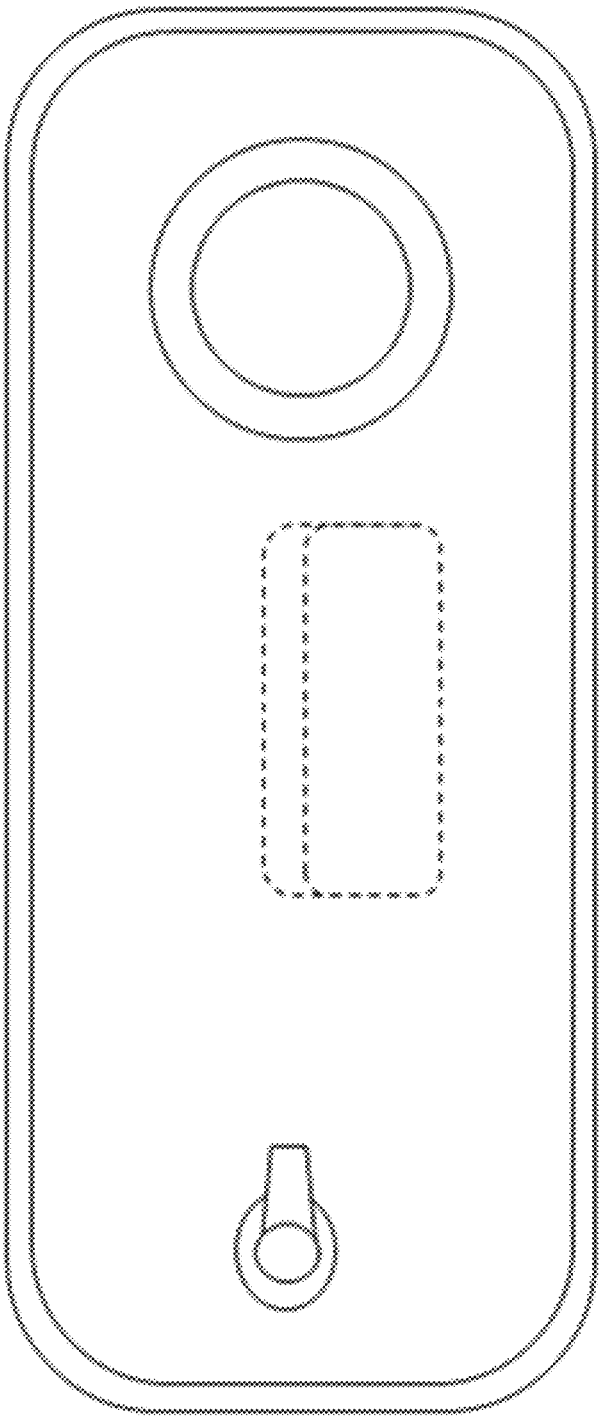
FIGS. 25A and 25B are front and side views of an exemplary reservoir with a baffle in its collapsed state.
Figure 25B:
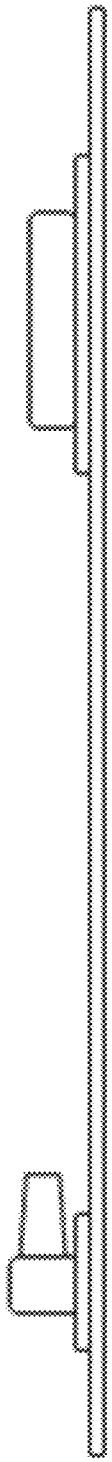

FIGS. 25A and 25B show front and side views of a reservoir with baffle in its collapsed state.

Figure 26A:
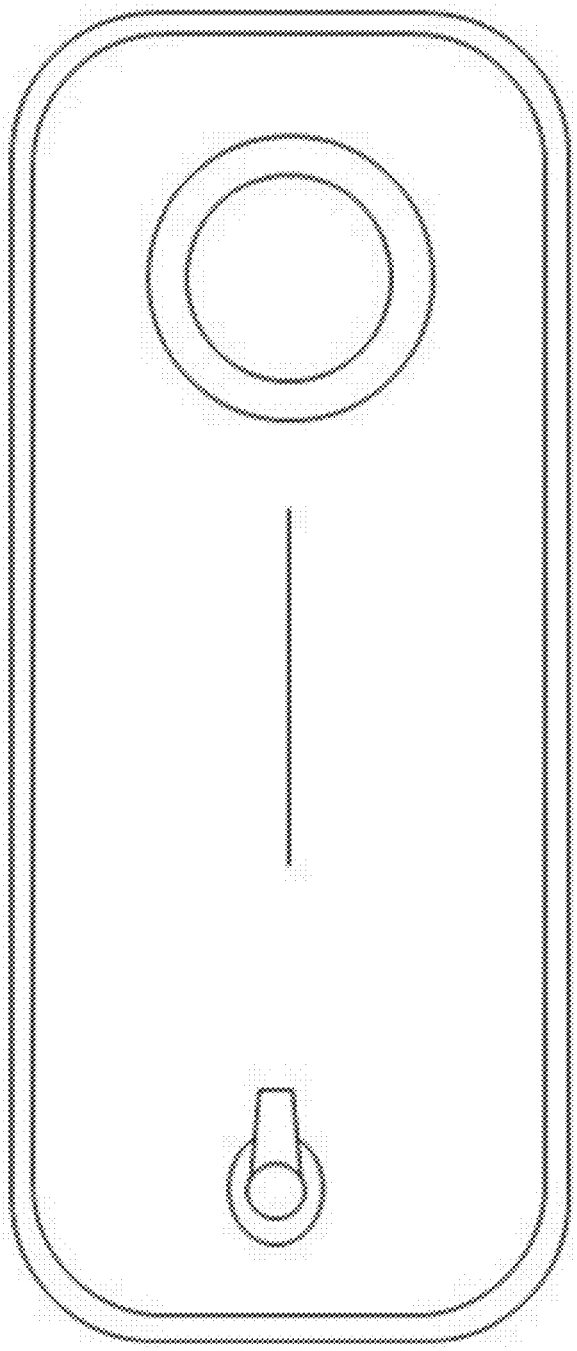
FIGS. 26A and 26B show front and side views of the reservoir with a baffle in an expanded state.
Figure 26B:
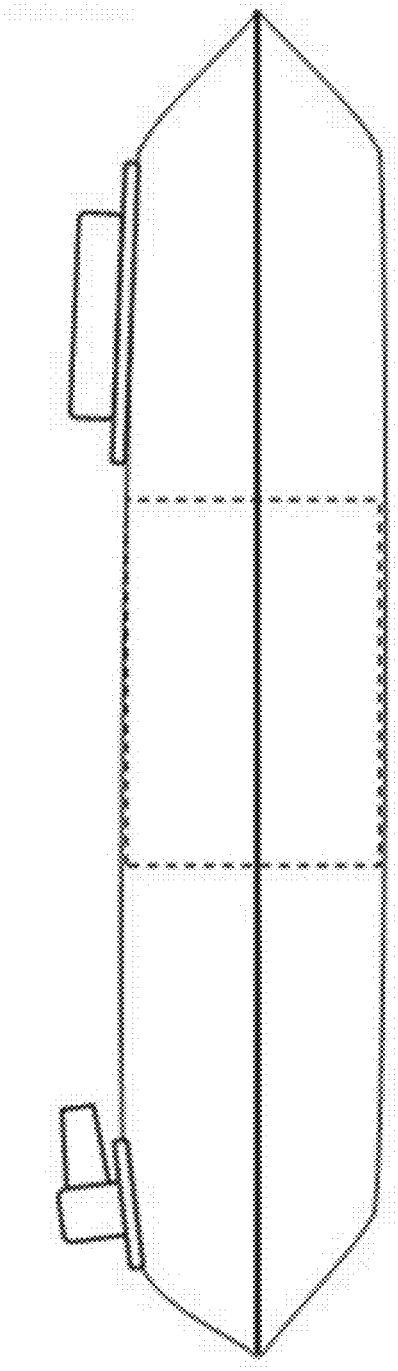

FIGS. 26A and 26B show front and side views of a reservoir with baffle in an expanded state.

Figure 27A:
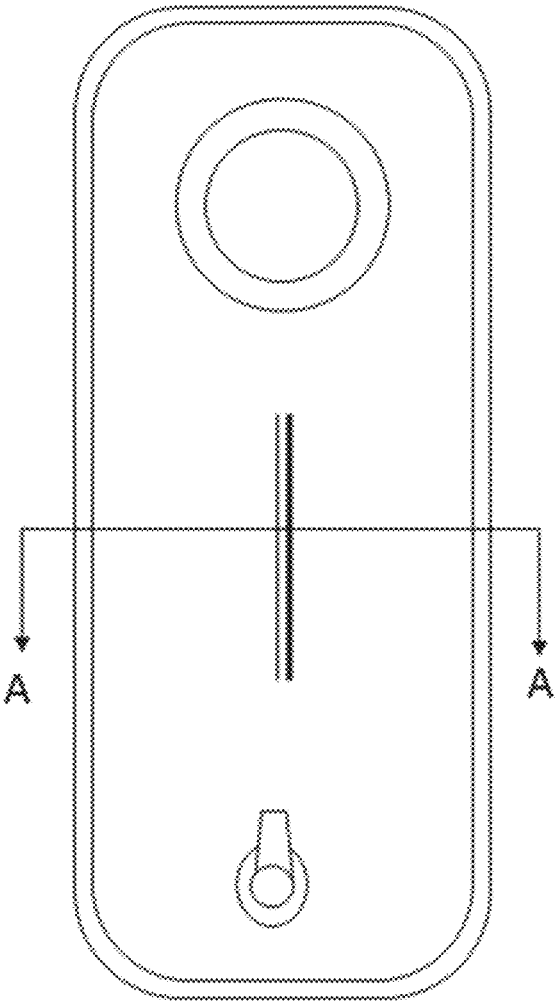
FIGS. 27A and 27B show front and side views of a reservoir with a baffle and a parallel rigid element in an expanded state.
Figure 27B:
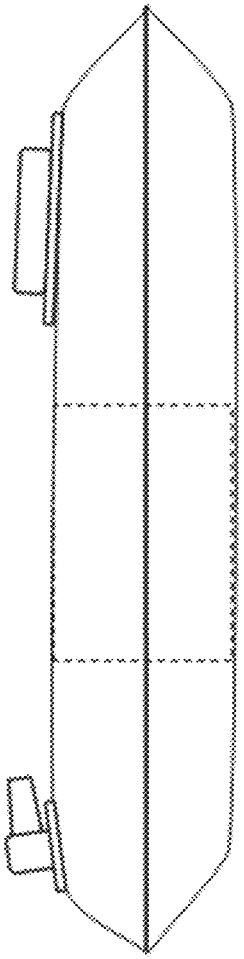
Figure 28A:
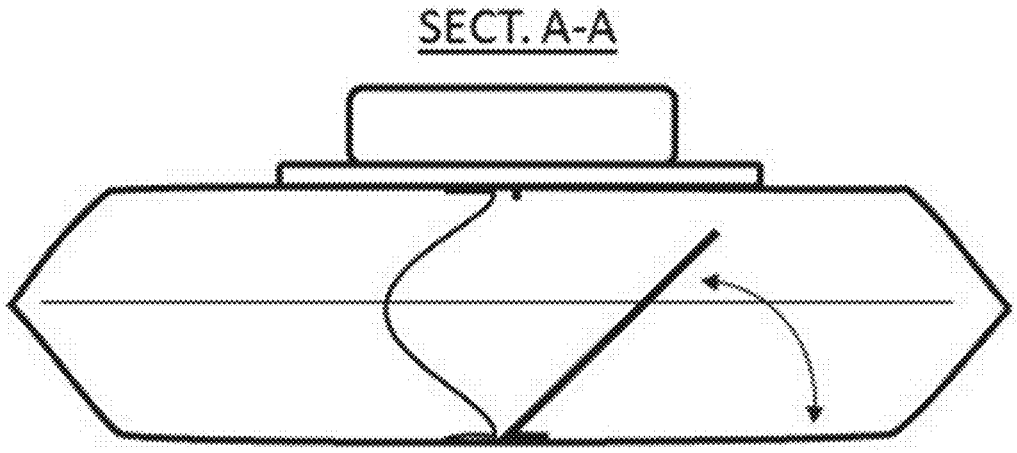
FIGS. 28A and 28B illustrate a transverse cross-section of the reservoir of FIGS. 27A and 27B showing a flexible baffle and hinged rigid element in the collapsed and expanded states.
Figure 28B:
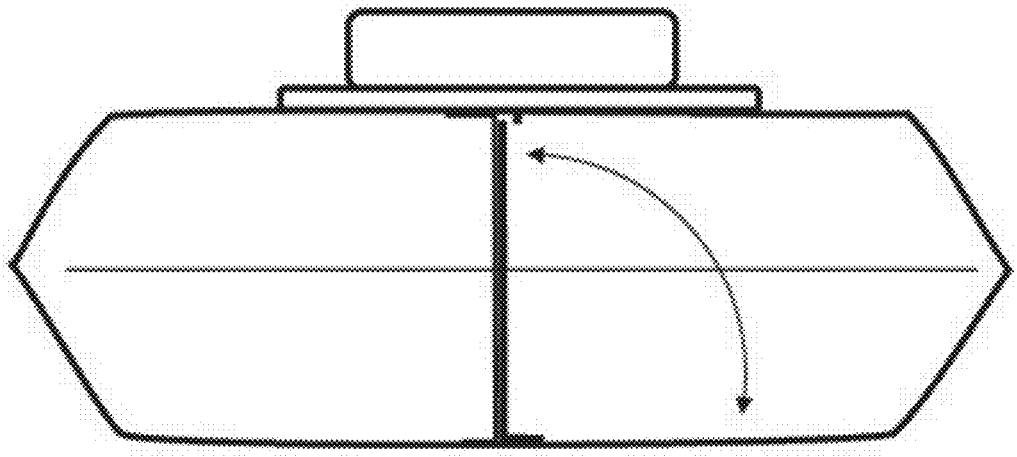

FIGS. 27A and 27B show front and side views of a reservoir with baffle and parallel rigid element in an expanded state. FIGS. 28A and 28B illustrate a transverse cross-section of the reservoir of FIGS. 27A and 27B showing a flexible baffle and hinged rigid element in the collapsed and then expanded state where the rigid element is rotated to a standing position to hold the reservoir walls apart.

Figure 29A:
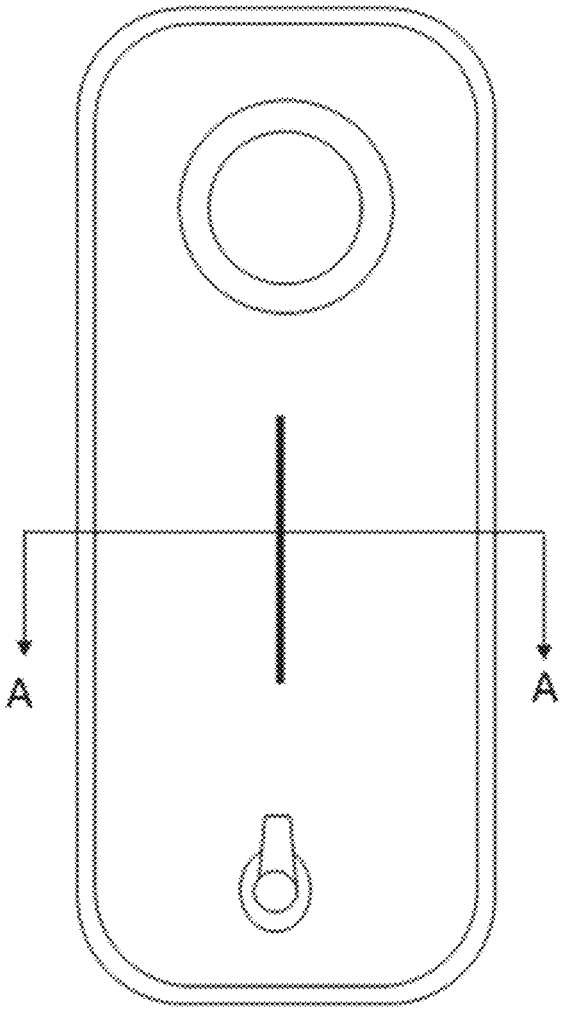
Figure 29B:
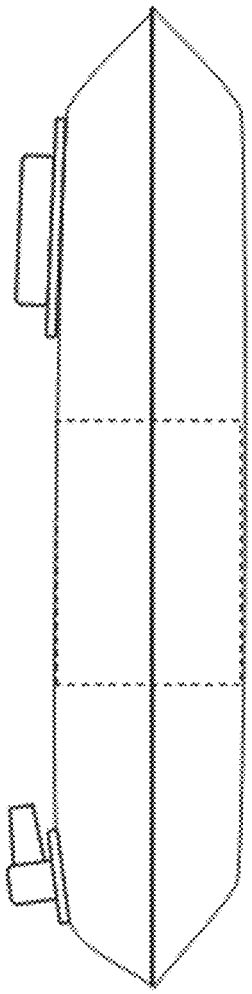
Figure 30A:
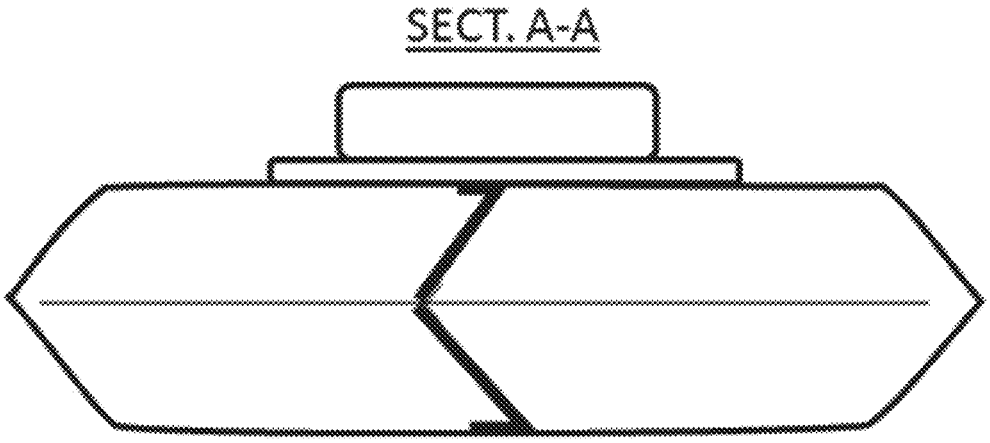
FIGS. 30A-30C illustrate a transverse cross-section of the reservoir showing a foldable rigid element in the collapsed and then expanded state.
Figure 30B:
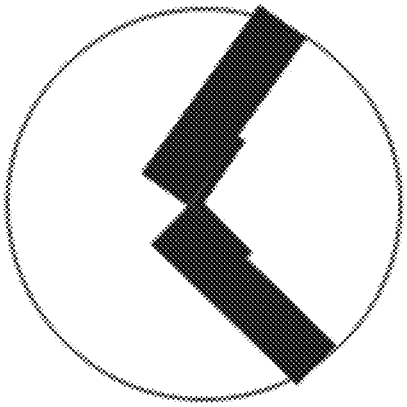
Figure 30C:
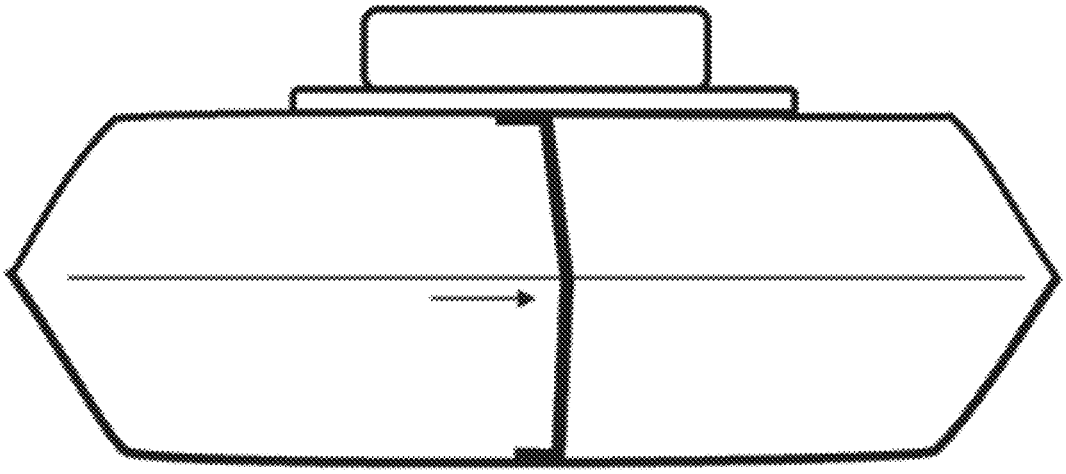

FIGS. 29A and 293 show front and side views of a reservoir with foldable rigid element in an expanded state. FIGS. 30A and 30C illustrate a transverse cross-section of the reservoir of FIGS. 29A and 293 showing a foldable rigid element (shown in detail in FIG. 303) in the collapsed and then expanded state where the rigid element is unfolded to achieve a standing position such that the reservoir walls are held apart.

Figure 31A:
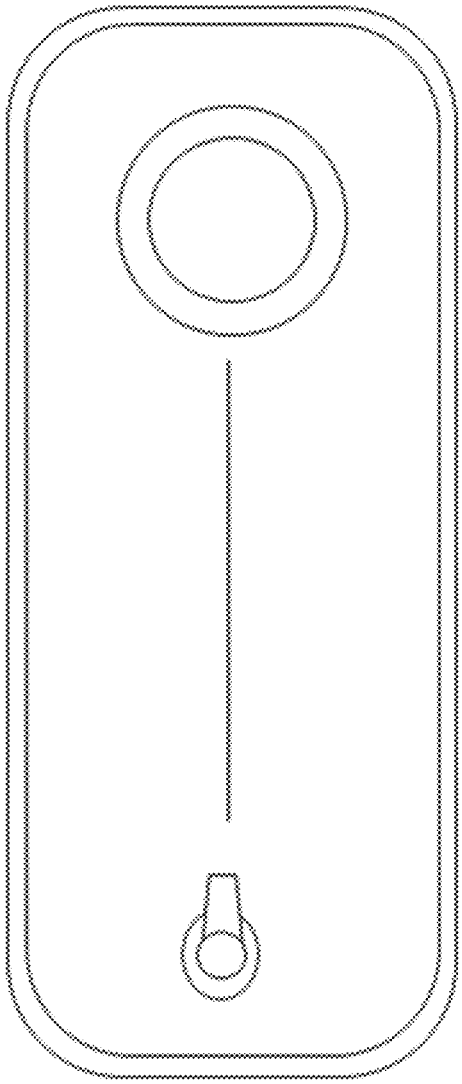
Figure 31B:
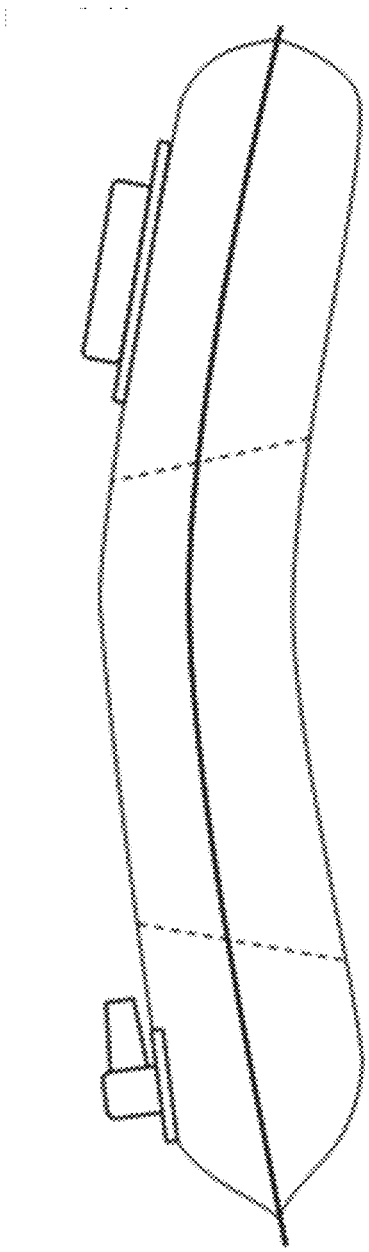
Figure 32A:
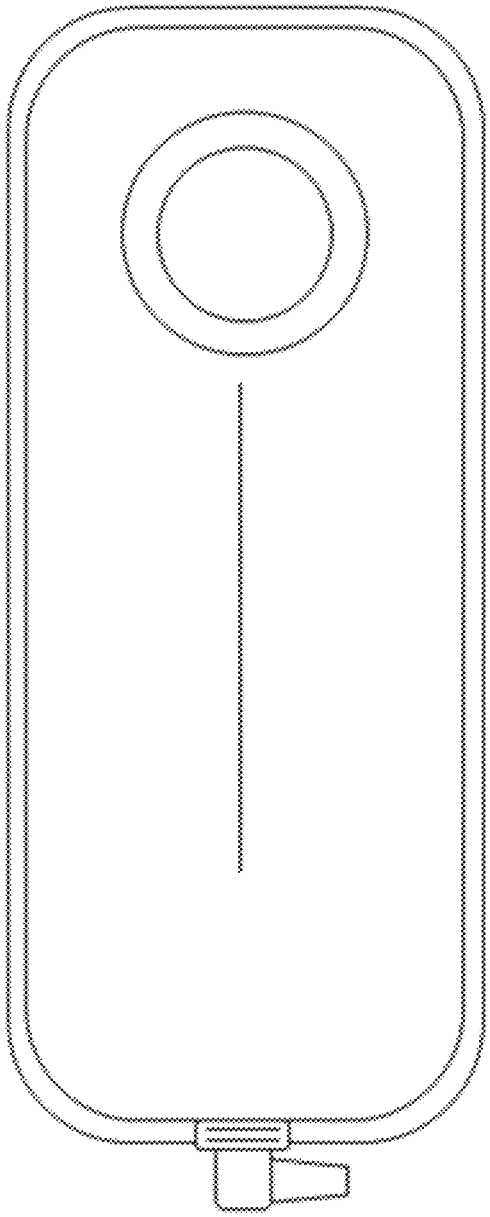
FIGS. 32A and 32B show front and side views of a reservoir with a seam-welded exit port and a shaped baffle in an expanded state.
Figure 32B:
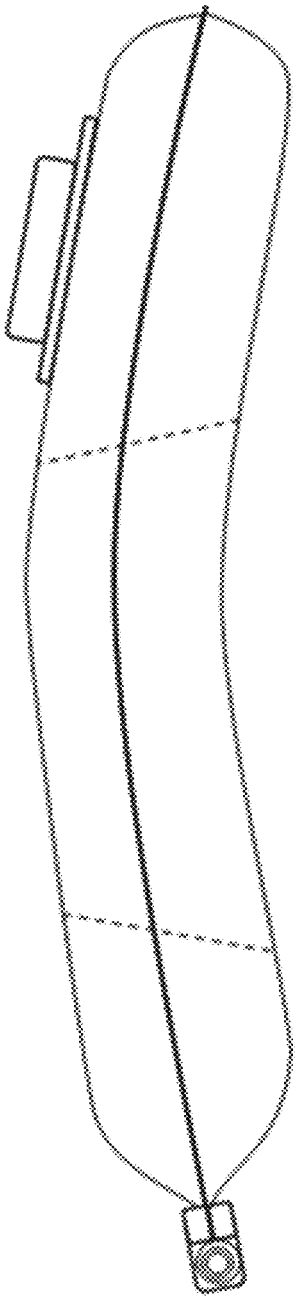
Figure 33A:
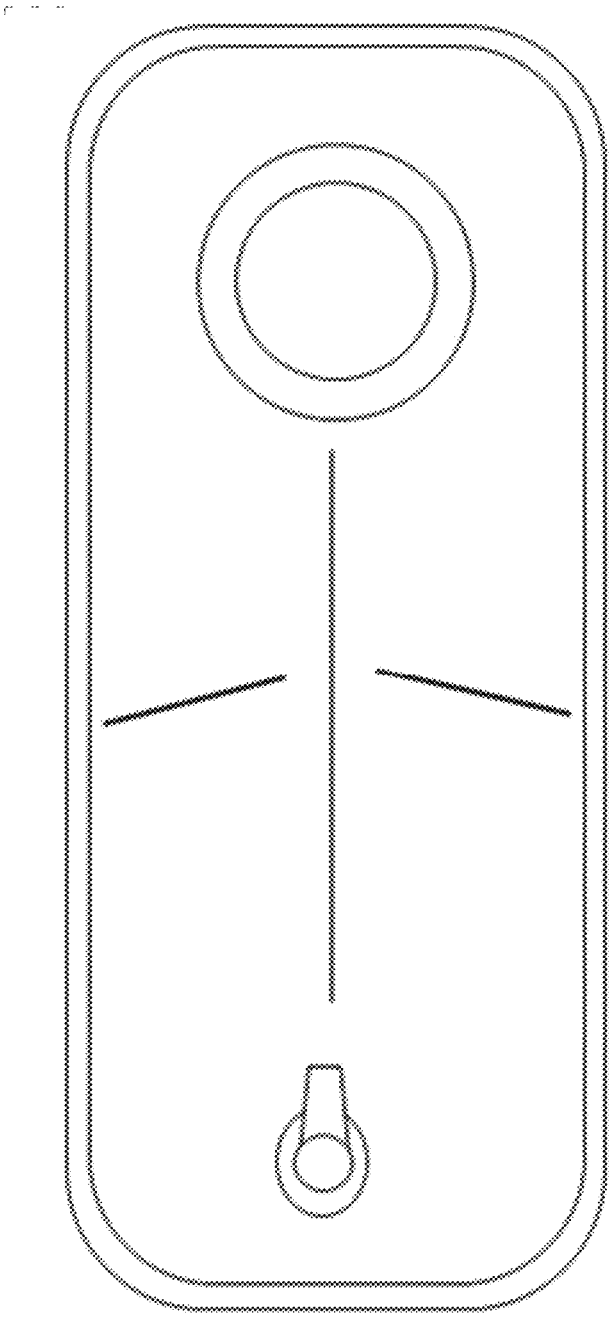
FIGS. 33A and 33B show front and side views of another reservoir including a shaped baffle.
Figure 33B:
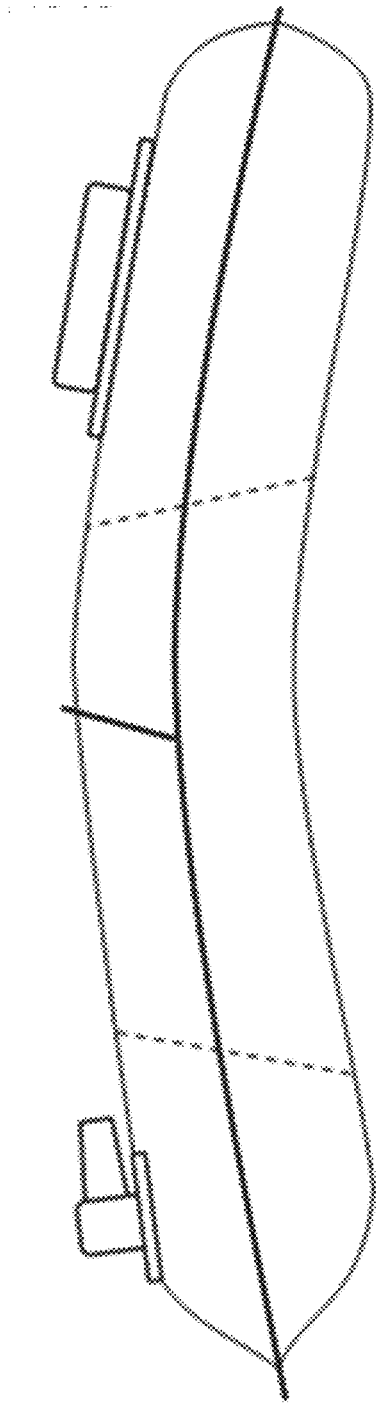
Figure 34A:
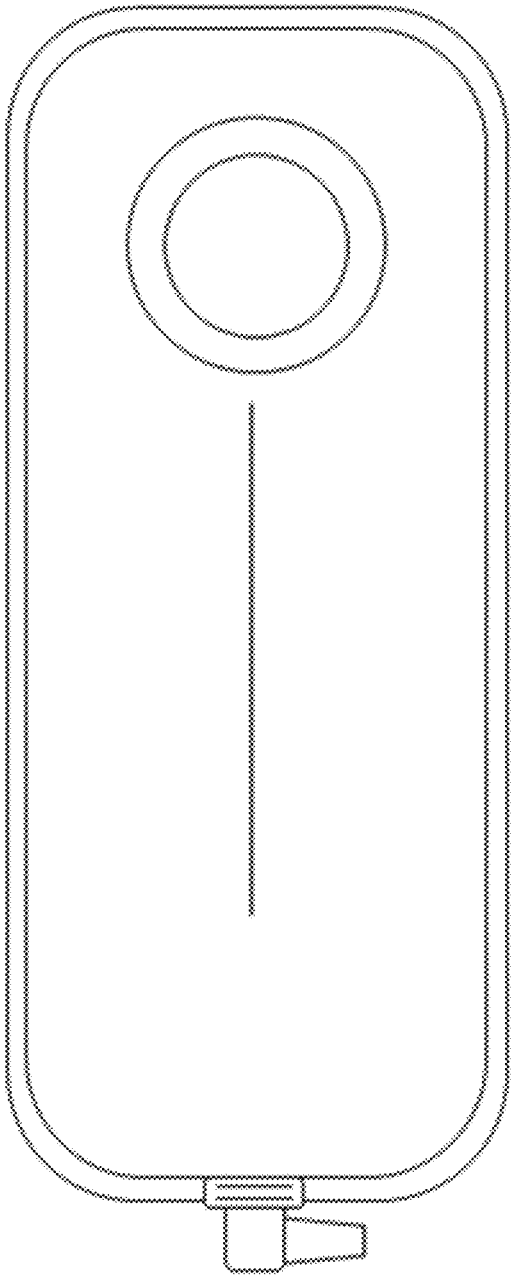
FIGS. 34A and 34B show front and side views of another reservoir including a shaped baffle.
Figure 34B:
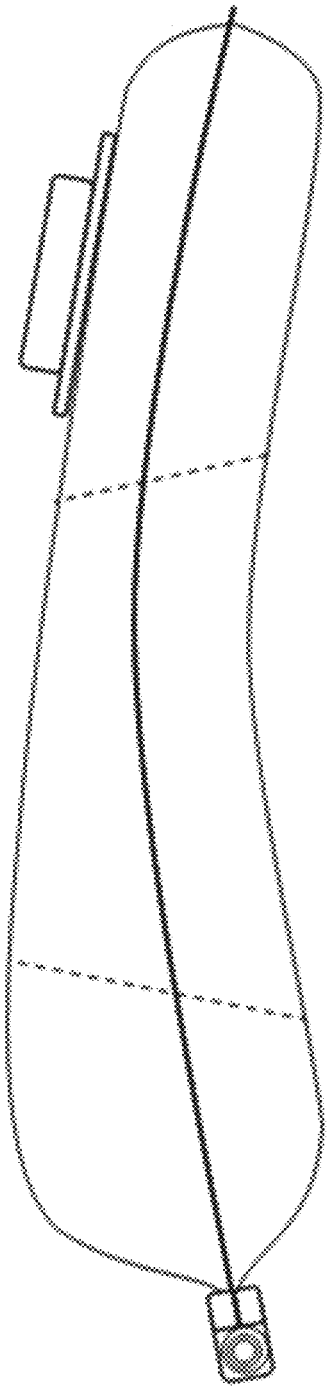

FIGS. 31A and 313 show front and side views of a reservoir with a shaped baffle in an expanded state. FIGS. 32A and 32B show front and side views of a reservoir with a seam-welded exit port at the bottom and a shaped baffle in an expanded state. FIGS. 33A and 33B show front and side views of a 3-D reservoir formed using pinch welds in the front sheet and including a shaped baffle. FIGS. 34A and 343 show front and side views of a 3-D reservoir with heat vacuum formed front and rear sheets and including a shaped baffle.

Figure 35A:
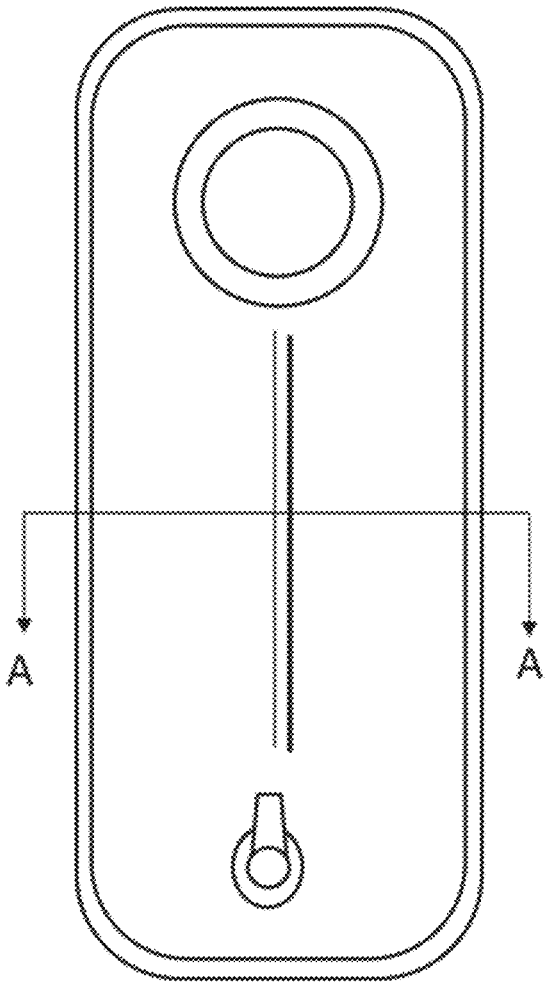
FIGS. 35A and 35B show front and side views of a reservoir with shaped baffle and parallel shaped rigid element in an expanded state.
Figure 35B:
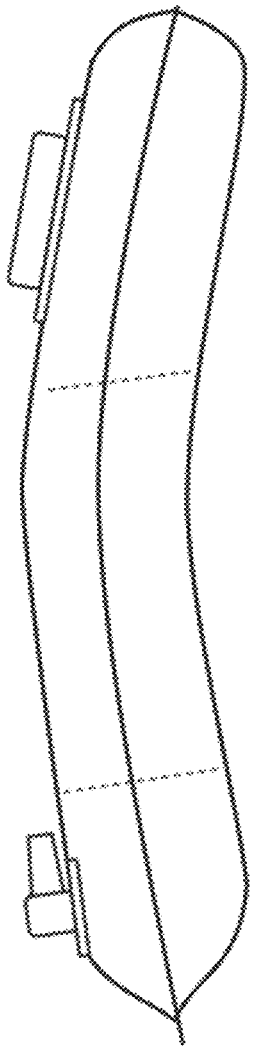
Figure 36A:
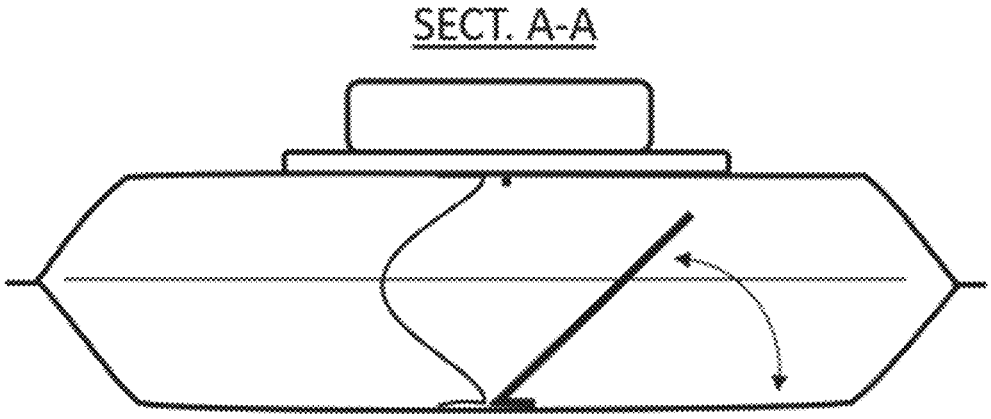
FIGS. 36A and 36B illustrate a transverse cross-section of the reservoir of FIGS. 35A and 35B showing a shaped flexible baffle and shaped hinged rigid element in the collapsed and then expanded state.
Figure 36B:
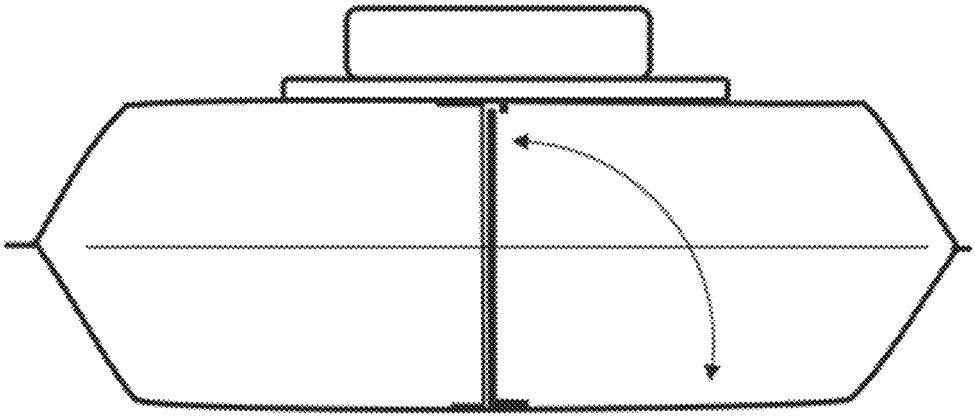

FIGS. 35A and 353 show front and side views of a reservoir with shaped baffle and parallel shaped rigid element in an expanded state. FIGS. 36A and 36B illustrate a transverse cross-section of the reservoir of FIGS. 35A and 353 showing a shaped flexible baffle and shaped hinged rigid element in the collapsed and then expanded state where the rigid element is rotated to a standing position to hold the reservoir walls apart.

Figure 37A:
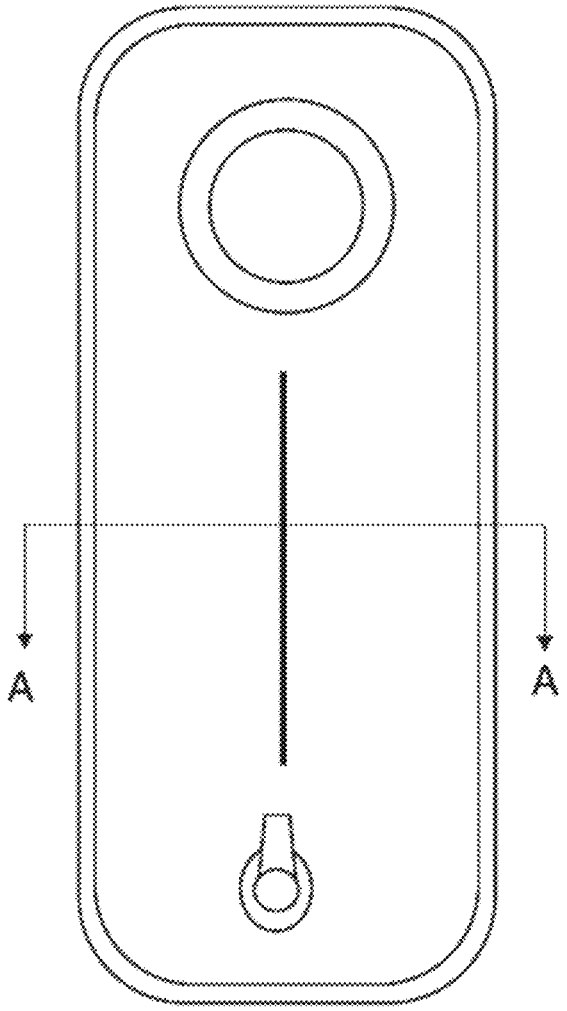
FIGS. 37A and 37B show front and side views of a reservoir with shaped folding rigid element in an expanded state.
Figure 37B:
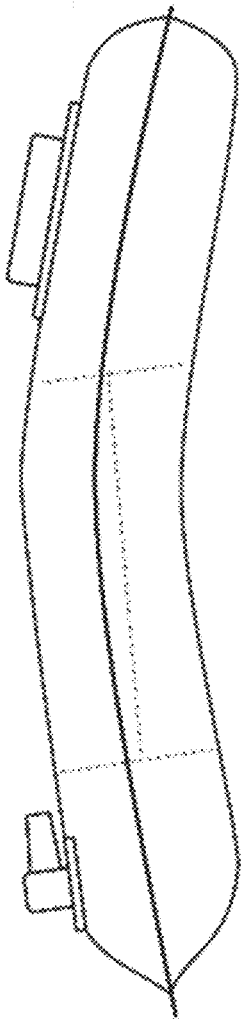
Figure 38A:
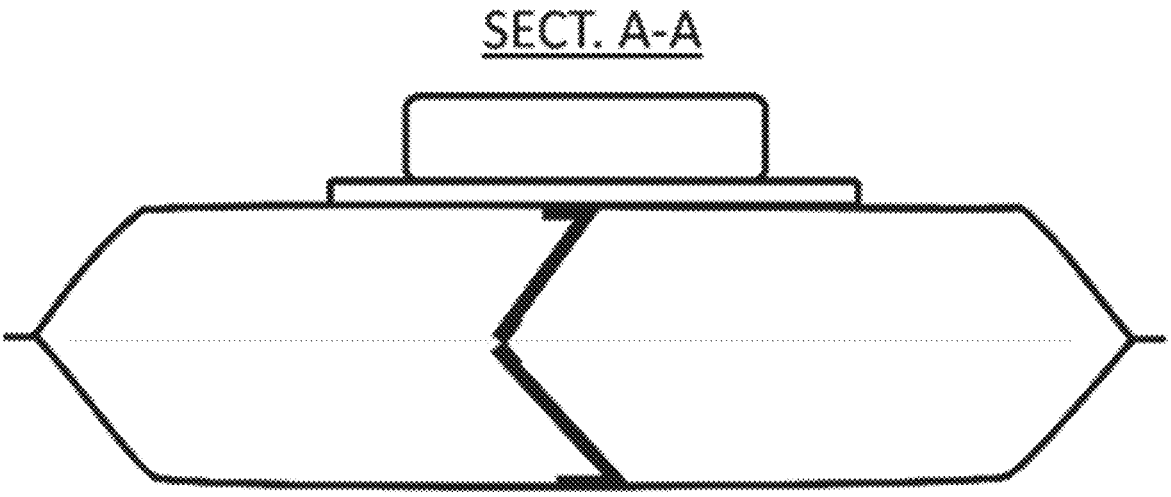
FIGS. 38A and 38B illustrate a transverse cross-section of the reservoir showing a shaped foldable rigid element in the collapsed and then expanded state.
Figure 38B:
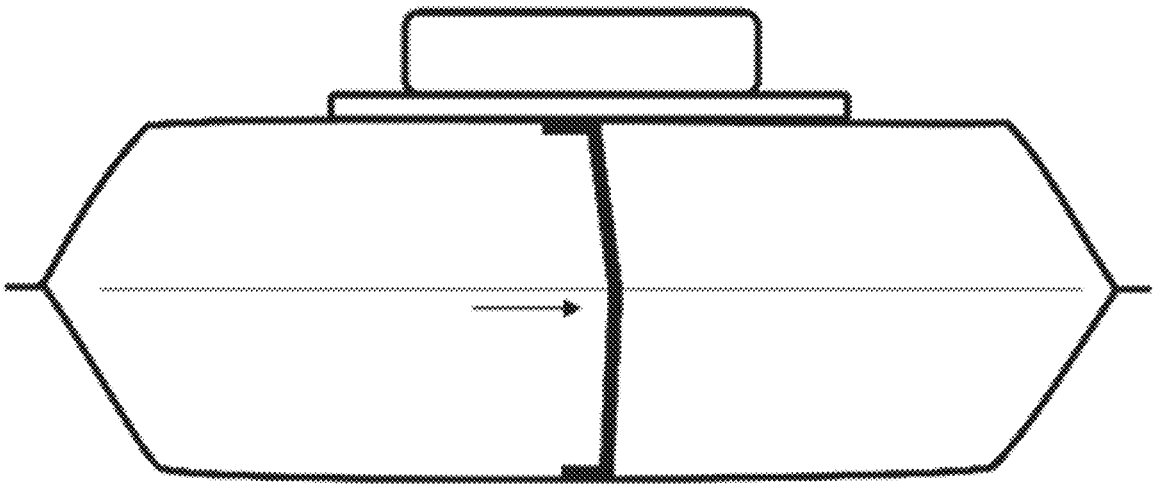

FIGS. 37A and 373 show front and side views of a reservoir with shaped folding rigid element in an expanded state. FIGS. 38A and 38B illustrate a transverse cross-section of the reservoir of FIGS. 37A and 373 showing a shaped foldable rigid element in the collapsed and then expanded state where the rigid element is unfolded to achieve a standing position such that the reservoir walls are held apart.

FIG. 39 shows a cross-sectional view of a reservoir having a resiliently deformable 2-shaped spring baffle that can both limit expansion between the two walls and resist the two walls being collapsed together. FIG. 40A shows a perspective view of an exemplary Z-shaped spring baffle that can be included in the reservoir of FIG. 39. In FIG. 40B, the 2-shaped spring baffle is made from a thicker and more resistant material compared to FIG. 40A. In FIG. 40C, the 2-shaped spring baffle includes embossed or dimpled features that are out of plane with the rest of the mid-section, or strut member, of the baffle to give the baffle additional resistance against crushing/buckling. The strut member can form an oblique angle relative to the first sheet and the second sheet when in the neutral position shown, and can tilt toward a flattened position parallel to the sheets when the bladder is flattened, and can tilt toward a perpendicular position when the bladder is expanded. As shown in FIG. 39, the first end of the baffle is coupled to a mid-portion of the first sheet between the perimeter edges, and the second end of the baffle is coupled to a mid-portion of the second sheet between the perimeter edges. The baffle and its strut portion are elongated in a direction extending lengthwise between an upper opening of the reservoir and a lower fluid outlet of the reservoir. As shown in FIG. 40C, the dimples are elongated in a direction extending between the first end of the baffle and the second end of the baffle.

Figure 41A:
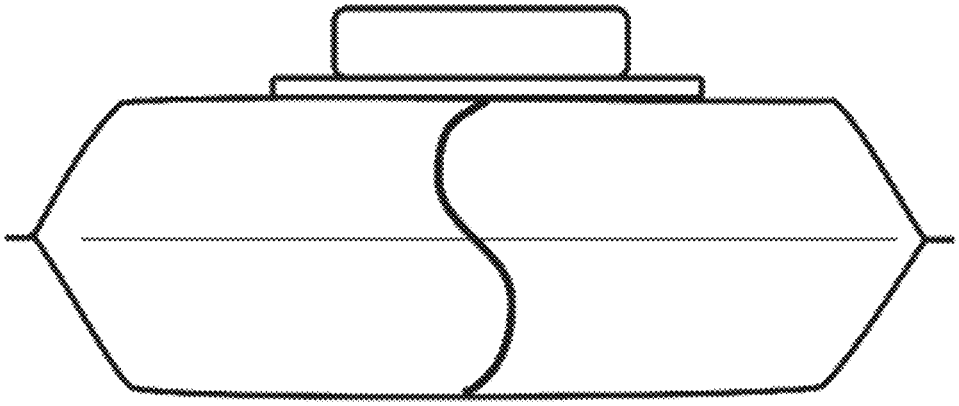
FIG. 41A is a cross-sectional view of a bladder having an S-shaped spring baffle.
Figure 41B:
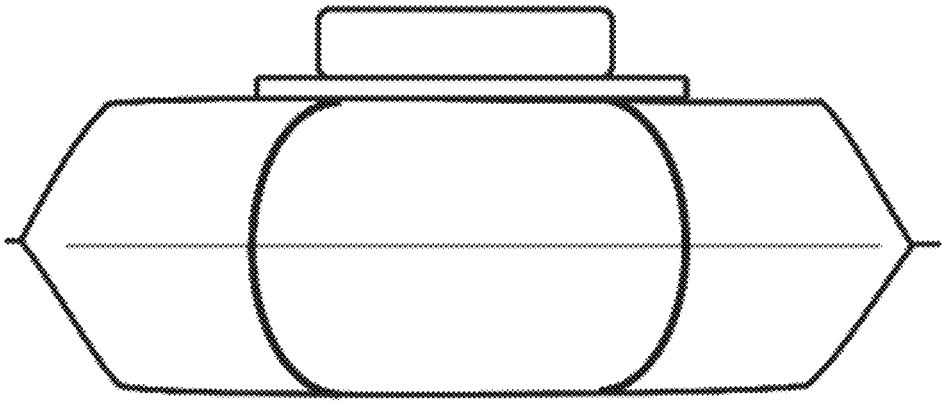
FIG. 41B is a cross-sectional view of a bladder having a pair of C-shaped spring baffles.
Figure 41C:
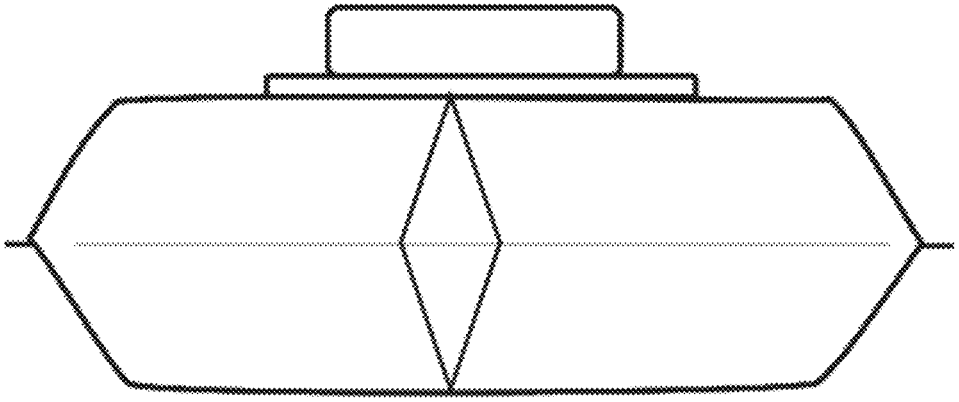
FIG. 41C is a cross-sectional view of a bladder having a diamond-shaped spring baffle.
Figure 41D:
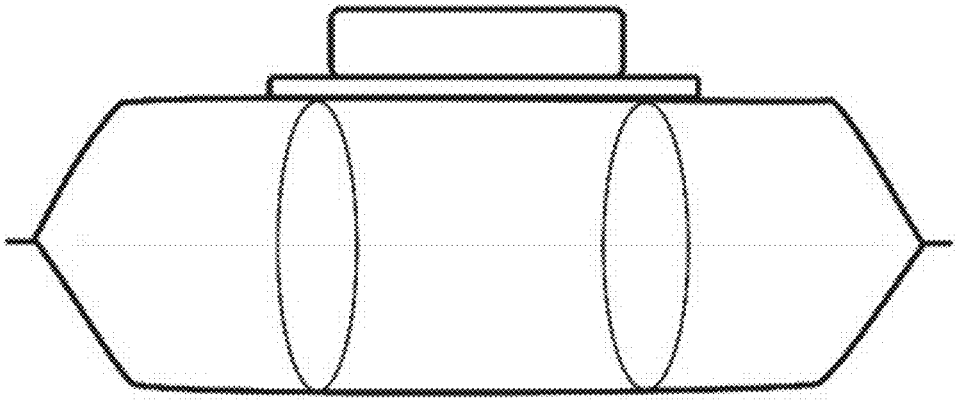
FIG. 41D is a cross-sectional view of a bladder having a pair of cylindrical baffles.
Figure 41E:
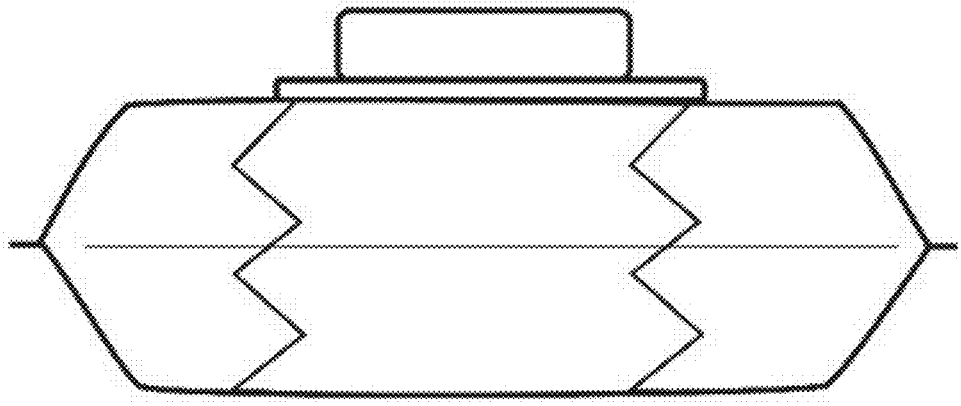
FIG. 41E is a cross-sectional view of a bladder having a pair of accordion-shaped baffles.
Figure 41F:
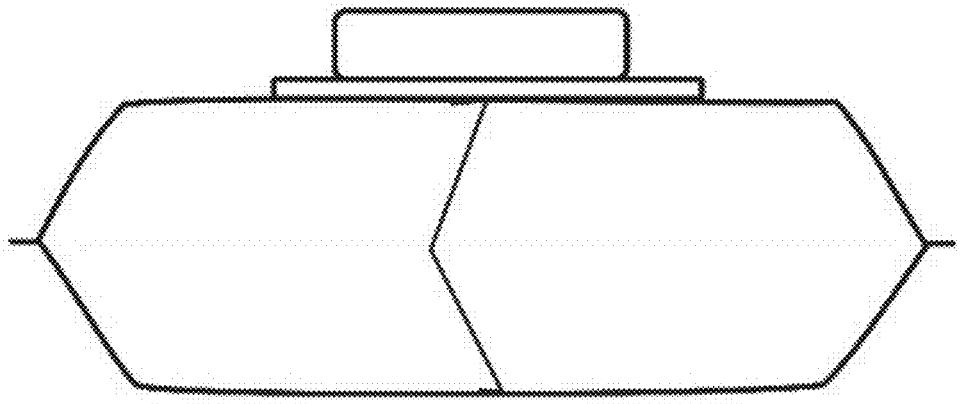
FIG. 41F is a cross-sectional view of a bladder having an a V-shaped spring baffle.

FIGS. 41A-41F shows cross-sectional views of reservoir having various resiliently deformable spring baffles. FIG. 41A shows an S-shaped spring baffle. FIG. 41B shows a pair of C-shaped spring baffles. FIG. 41C shows a diamond-shaped spring baffle. FIG. 41D shows a pair of cylindrical baffles. FIG. 41E depicts a pair of accordion-shaped baffles. FIG. 41F shows a V-shaped spring baffle.

Figure 42A:
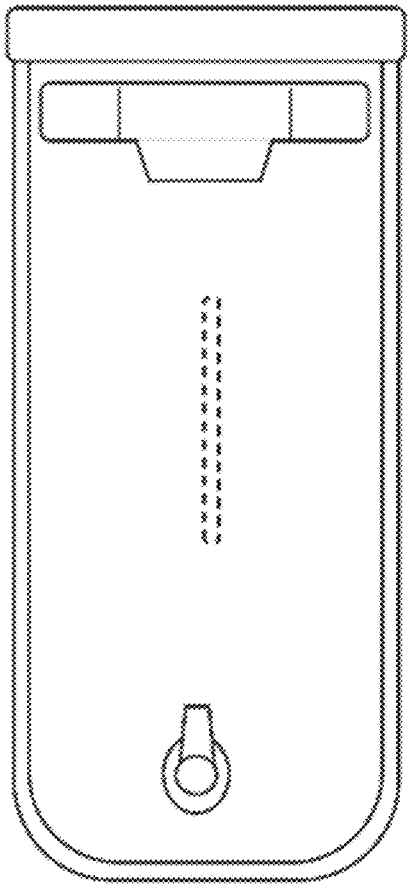
FIGS. 42A and 42B illustrate a slide top reservoir with an interior baffle and front and back spring members near the reservoir opening.
Figure 42B:
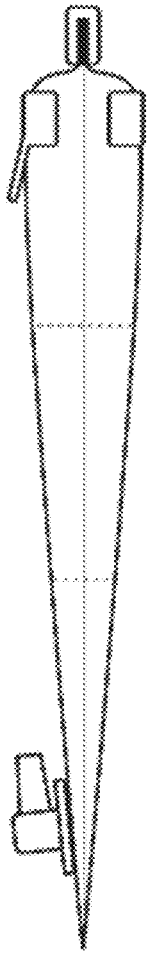
Figure 43A:
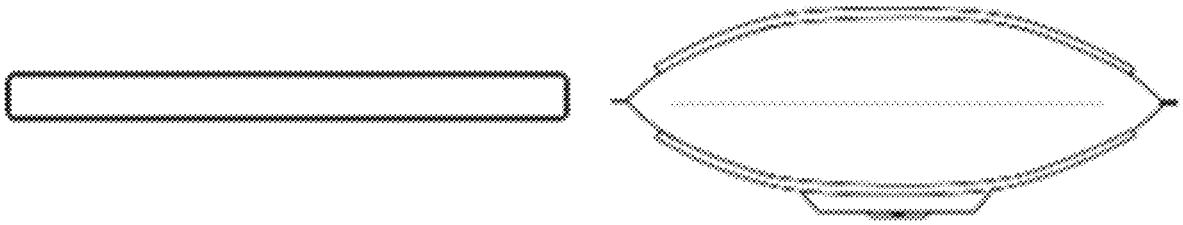
FIGS. 43A and 43B show a top view and front view of the slide top reservoir in an open position.
Figure 43B:
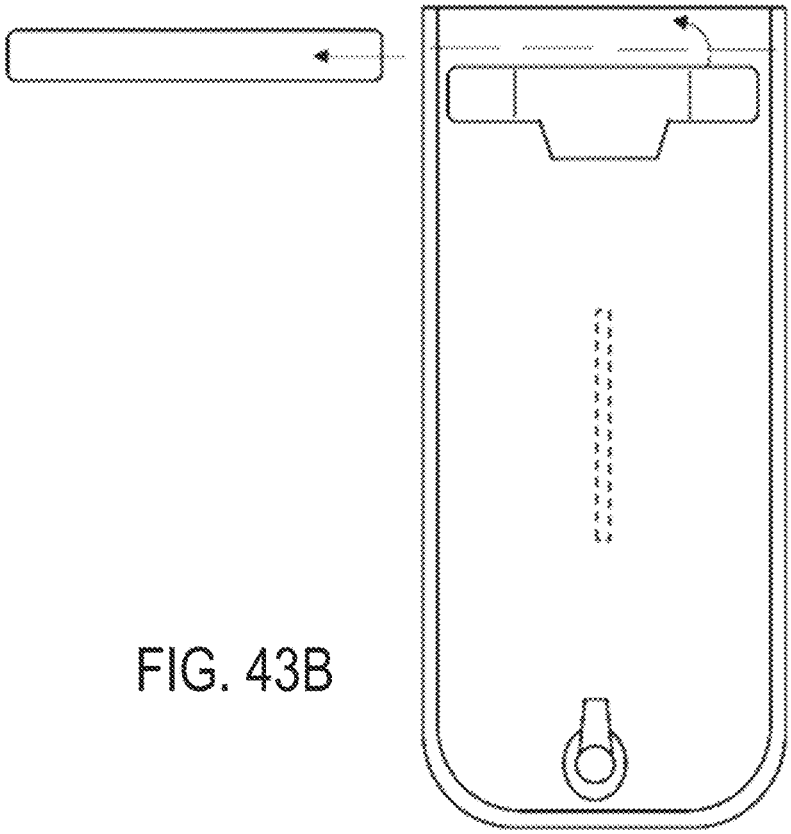
Figure 43C:
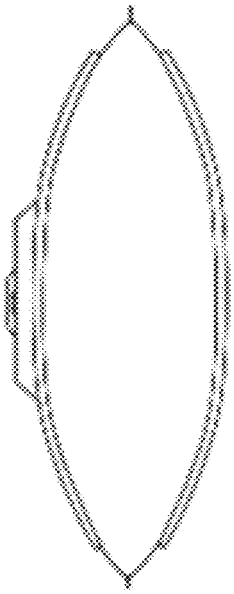
FIGS. 43C and 43D show a top view and side view of the slide top reservoir in an open position.
Figure 43D:
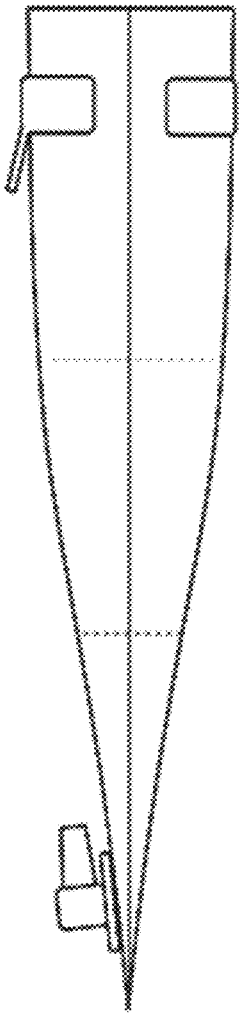

FIGS. 42A and 42B illustrate a slide top reservoir with an interior baffle and front and back spring members coupled to the front and rear walls near the reservoir opening. FIGS. 43A and 43B show a top view and front view of the slide top reservoir of FIGS. 42A and 42B in an open position with an internal baffle and spring members attached to the front and back of the reservoir walk. FIGS. 43C and 43D show a top view and side view of the slide top reservoir with the spring members holding the upper opening in an open position. The front and back spring members can comprise pre-formed curved members that are resiliently deformable and are biased toward the curved, open position of FIGS. 43C and 43D.

Figure 44A:
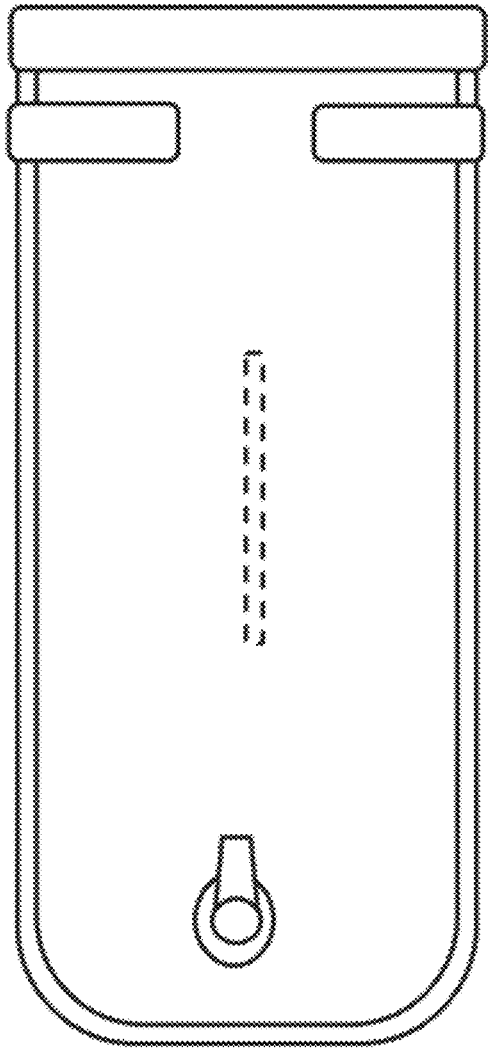
FIGS. 44A and 44B illustrate another slide top reservoir with an interior baffle and left and right spring members near the reservoir opening.
Figure 44B:
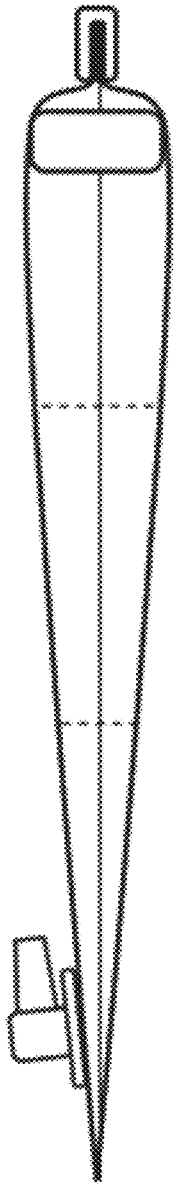
Figure 45A:
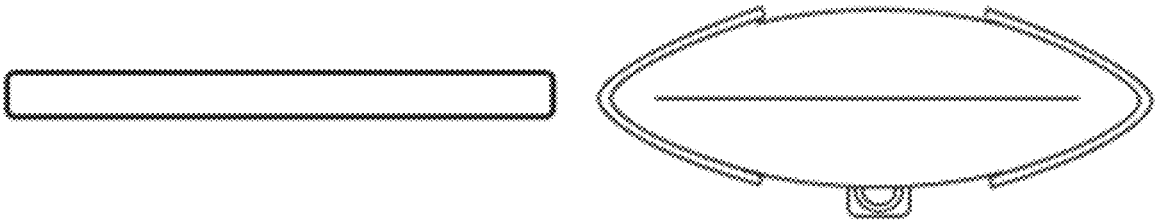
FIGS. 45A and 45B show a top view and front view of the slide top reservoir of FIGS. 44A and 44B in an open position.
Figure 45B:
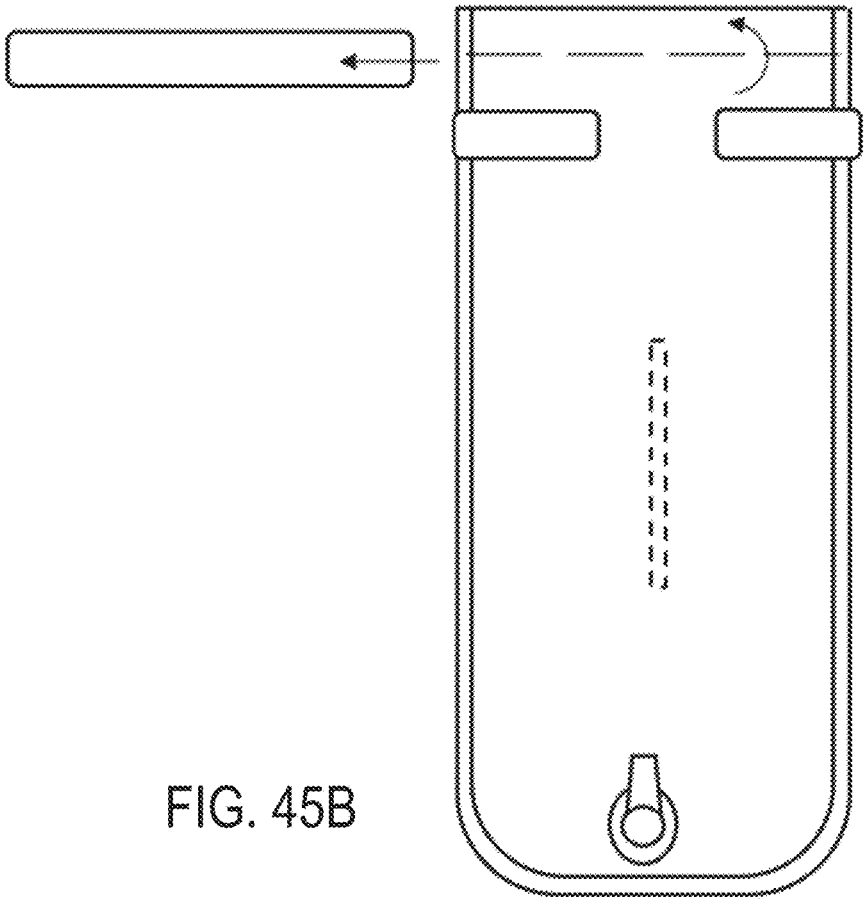
Figure 45C:
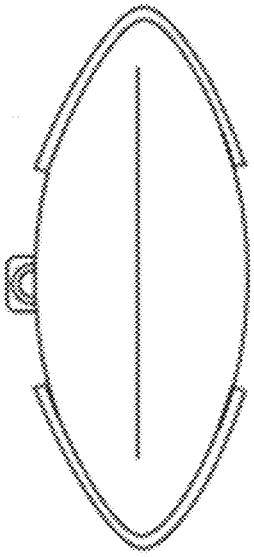
FIGS. 45C and 45D show a top view and side view of the slide top reservoir of FIGS. 44A and 44B in an open position.
Figure 45D:
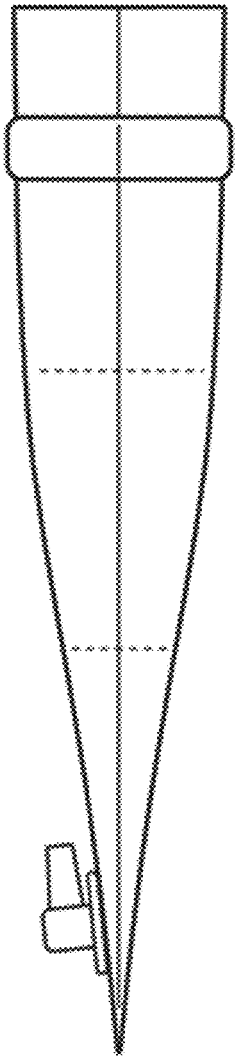

FIGS. 44A and 44B illustrate another slide top reservoir with an interior baffle, comprising left and right side spring members near the reservoir opening. In this embodiment, the spring members are V-shaped and mounted around the side seams of the bladder, each coupled to both the front and rear walls, FIGS. 45A and 45B show a top view and front view of the slide top reservoir of FIGS. 44A and 44B in an open position with the internal baffle and the spring members attached around the left and right sides of the reservoir holding the upper opening open, FIGS. 45C and 45D show a top view and side view of the slide top reservoir in an open position.

In view of the many possible embodiments to which the principles of the disclosed invention may be applied, it should be recognized that the illustrated embodiments are only preferred examples of the invention and should not be taken as limiting the scope of the disclosure.

The invention claimed is:

1. A fluid reservoir, comprising:

a 3-D formed first sheet and a 3-D formed second sheet, wherein the 3-D formed first sheet and the 3-D formed second sheet are sealed together at least partially around respective perimeter edges thereof to define an internal space for fluid storage, and wherein the 3-D formed first sheet and 3-D formed second sheet have different shapes that when sealed together define a curved vertical profile of the fluid reservoir;

a first opening defined between the 3-D formed first sheet and the 3-D formed second sheet at a first end of the fluid reservoir, wherein the first opening is fitted with a first plate sealed to the 3-D formed first sheet and a second plate sealed to the 3-D formed second sheet to define a fill port configured for filling the fluid reservoir with fluid;

a second opening defined between the 3-D formed first sheet and the 3-D formed second sheet at a second end of the fluid reservoir opposite the first end, the second opening having a fluid exit port seam-welded to the 3-D formed first sheet and the 3-D formed second sheet and configured for allowing fluid to exit the fluid reservoir;

at least one collapsible baffle formed of a web of flexible material, the collapsible baffle being positioned within the internal space and having a first end welded to the 3-D formed first sheet and a second end welded to the 3-D formed second sheet, wherein the 3-D formed first sheet and 3-D formed second sheet have a continuous outer profile on respective outer surfaces thereof in areas adjacent the first and second ends of the baffle.

2. The fluid reservoir of claim 1, wherein the first opening is larger than the second opening.

3. The fluid reservoir of claim 1, wherein the fluid exit port is configured for connecting to a fluid transfer tube.

4. The fluid reservoir of claim 1, herein the fluid exit port comprises an outlet valve.

5. The fluid reservoir of claim 1, wherein the at least one baffle is a first baffle, further comprising a second baffle spaced apart from the first baffle.

6. The fluid reservoir of claim 1, further comprising a closure mechanism positioned adjacent a first end of the fluid reservoir, wherein the closure mechanism is configured to press the 3-D formed first sheet and the 3-D formed second sheet together from opposite sides to seal off the first opening, and wherein the closure mechanism comprises a lock movable to a locked position to retain the closure mechanism in a closed state.

7. The fluid reservoir of claim 1, wherein the fluid reservoir is configurable in a collapsed state in which the internal space is reduced from a non-collapsed state.

8. The fluid reservoir of claim 1, wherein the fluid exit port comprises an outlet valve oriented perpendicular to the vertical profile.

* * * * *